US012055160B2

(12) United States Patent
Tanaka et al.

(10) Patent No.: US 12,055,160 B2
(45) Date of Patent: Aug. 6, 2024

(54) NON-CLOGGING PUMP

(71) Applicant: Tsurumi Manufacturing Co., Ltd., Osaka (JP)

(72) Inventors: Hiroyuki Tanaka, Yawata (JP); Yasushi Torimoto, Yawata (JP); Shingo Yoshida, Yawata (JP); Jumpei Ogawa, Yawata (JP); Daichi Umeki, Yawata (JP)

(73) Assignee: Tsurumi Manufacturing Co., Ltd., Osaka (JP)

( * ) Notice: Subject to any disclaimer, the term of this patent is extended or adjusted under 35 U.S.C. 154(b) by 0 days.

(21) Appl. No.: 17/780,350

(22) PCT Filed: Nov. 16, 2020

(86) PCT No.: PCT/JP2020/042663
§ 371 (c)(1),
(2) Date: May 26, 2022

(87) PCT Pub. No.: WO2021/106658
PCT Pub. Date: Jun. 3, 2021

(65) Prior Publication Data

US 2023/0011208 A1 Jan. 12, 2023

(30) Foreign Application Priority Data

Nov. 26, 2019 (JP) ..... 2019-213397

(51) Int. Cl.
*F04D 7/04* (2006.01)
*F04D 13/08* (2006.01)
(Continued)

(52) U.S. Cl.
CPC ..... *F04D 7/045* (2013.01); *F04D 13/08* (2013.01); *F04D 29/20* (2013.01);
(Continued)

(58) Field of Classification Search
CPC ..... F04D 13/06; F04D 13/08; F04D 13/086; F04D 15/0066; F04D 15/02;
(Continued)

(56) References Cited

U.S. PATENT DOCUMENTS 3,692,422 A 9/1972 Girardier
8,109,730 B2 2/2012 Andersson
(Continued)

FOREIGN PATENT DOCUMENTS

CN 203394823 U 1/2014
CN 204099270 U * 1/2015 ..... F04D 13/08
(Continued)

OTHER PUBLICATIONS

International Search Report (PCT/ISA/210) issued in PCT Application No. PCT/JP2020/042663 Jan. 19, 2021 with English translation (five (5) pages).
(Continued)

*Primary Examiner* — Devon C Kramer
*Assistant Examiner* — Chirag Jariwala
(74) *Attorney, Agent, or Firm* — Crowell & Moring LLP

(57) ABSTRACT

A non-clogging pump includes a pump casing and an impeller that includes a main plate portion and a vane portion, in which the main plate portion includes a main plate protrusion portion that protrudes in a counter-inflow direction, the vane portion includes a first end face and a second end face and is connected to the main plate protrusion portion at an inner periphery-side end portion, and an inner peripheral wall that forms the suction port of the pump casing includes a suction port protrusion portion that is provided at a portion in a rotation direction of the rotating shaft, is disposed along the second end face with a gap from the second end face, and protrudes toward a center side of the suction port.

23 Claims, 14 Drawing Sheets

(51) Int. Cl.

| | |
|---|---|
| ***F04D 29/20*** | (2006.01) |
| ***F04D 29/22*** | (2006.01) |
| ***F04D 29/24*** | (2006.01) |
| ***F04D 29/42*** | (2006.01) |
| ***F04D 29/70*** | (2006.01) |

(52) U.S. Cl.
CPC ..... *F04D 29/2288* (2013.01); *F04D 29/242* (2013.01); *F04D 29/426* (2013.01); *F04D 29/4273* (2013.01); *F04D 29/708* (2013.01)

(58) Field of Classification Search
CPC ..... F04D 15/0209; F04D 15/0245; F04D 15/0254; F04D 15/0263; F04D 15/0272; F04D 29/24; F04D 29/242; F04D 29/245; F04D 29/40; F04D 29/406; F04D 29/42; F04D 29/426; F04D 29/4273; F04D 29/4293; F04D 7/045; F04D 29/20; F04D 29/2288; F04D 29/708
See application file for complete search history.

(56) References Cited

U.S. PATENT DOCUMENTS

| | | | | |
|---|---|---|---|---|
| 10,837,462 | B2 | 11/2020 | Kawai et al. | |
| 11,236,757 | B2 * | 2/2022 | Bergh | F16D 1/097 |
| 2007/0154321 | A1 * | 7/2007 | Stiles, Jr. | F04B 49/02 417/44.1 |
| 2009/0123270 | A1 * | 5/2009 | Andersson | F04D 29/042 415/140 |
| 2009/0169365 | A1 | 7/2009 | Andersson | |
| 2011/0255970 | A1 * | 10/2011 | Fei | F04D 29/247 416/44 |
| 2018/0051718 | A1 * | 2/2018 | Kawai | F04D 7/045 |
| 2020/0240428 | A1 * | 7/2020 | Springer | F04D 29/2294 |

FOREIGN PATENT DOCUMENTS

| | | | | | |
|---|---|---|---|---|---|
| JP | 51-36721 | Y2 | | 9/1976 | |
| JP | 2636966 | B2 | | 8/1997 | |
| JP | 2005-90313 | A | | 4/2005 | |
| JP | 2008-545093 | A | | 12/2008 | |
| JP | 2014-34885 | A | | 2/2014 | |
| JP | 6488167 | B2 | | 3/2019 | |
| JP | 2019-143630 | A | | 8/2019 | |
| KR | 10-0722507 | B1 | | 5/2007 | |
| KR | 20130104706 | A | * | 9/2013 | F04D 13/08 |
| KR | 101353776 | B1 | * | 1/2014 | F04D 13/08 |
| KR | 20170101563 | A | * | 2/2018 | F04D 13/08 |
| WO | WO 2017/198509 | A1 | | 11/2017 | |

OTHER PUBLICATIONS

Japanese-language Written Opinion (PCT/ISA/237) issued in PCT Application No. PCT/JP2020/042663 dated Jan. 19, 2021 (four (4) pages).
Extended European Search Report issued in European Application No. 20894890.1 dated Dec. 11, 2023 (11 pages).
Japanese-language Office Action issued in Japanese Application No. 2023-073780 dated Dec. 19, 2023 with English translation (8 pages).
Korean-language Office Action issued in Korean Application No. 10-2022-7009284 dated Feb. 19, 2024 with English translation (12 pages).

* cited by examiner

CROSS SECTION ALONG LINE 800-800

MODIFICATION EXAMPLE

NON-CLOGGING PUMP

TECHNICAL FIELD

The present invention relates to a non-clogging pump.

BACKGROUND ART

In the related art, a non-clogging pump provided with an impeller is known. Such a non-clogging pump is disclosed in Japanese Unexamined Patent Publication No. 2005-90313.

Japanese Unexamined Patent Publication No. 2005-90313 discloses a vertical type non-clogging pump that includes an impeller and a flow straightener disposed immediately below the impeller and outside a suction port. The flow straightener includes a flow straightening plate that guides and pushes fibrous foreign matter having a cloth shape, a strip shape, or the like toward the outer periphery side of the impeller. The flow straightening plate is formed so as to spread in a tapered shape and radially from the lower side toward the upper side. The flow straightener is configured to pass the foreign matter by guiding and pushing the foreign matter toward the outer periphery side of the impeller by the flow straightening plate.

CITATION LIST

Patent Literature

[PTL 1] Japanese Unexamined Patent Publication No. 2005-90313

SUMMARY OF INVENTION

Technical Problem

However, in the non-clogging pump disclosed in Japanese Unexamined Patent Publication No. 2005-90313, since the flow straightener is disposed immediately below the impeller, there is a case where the foreign matter is caught between the flow straightener and the impeller, and therefore, there is a problem in that the passage performance of the foreign matter is poor. Further, in the non-clogging pump disclosed in Japanese Unexamined Patent Publication No. 2005-90313, since the flow straightener is provided as a dedicated configuration for passing the foreign matter on the suction port side of the impeller, there is also a problem in that a device configuration is complicated.

The present invention has been made in order to solve the problems as described above, and an object of the present invention is to provide a non-clogging pump in which it is possible to improve the passage performance of foreign matter without complicating a device configuration.

Solution to Problem

In order to achieve the above object, according to an aspect of the present invention, there is provided a non-clogging pump including: a pump casing provided with a suction port; and an impeller that includes a main plate portion and two or more vane portions that are disposed on a suction port side of the main plate portion, is fixed to one end of a rotating shaft, and is disposed inside the pump casing, in which the main plate portion includes a main plate protrusion portion that protrudes in a counter-inflow direction that is a direction opposite to an inflow direction of water from the suction port, which substantially coincides with an axial direction of the rotating shaft, toward an inner periphery side in a radial direction of the rotating shaft, the vane portion includes a first end face that is an end face in the counter-inflow direction, which is located on an outer periphery side in the radial direction, and extends in a direction intersecting the counter-inflow direction, and a second end face that is an end face in the counter-inflow direction, which is connected to the first end face from the inner periphery side in the radial direction of the first end face and located on the inner periphery side in the radial direction, and is inclined with respect to the first end face so as to be located on a counter-inflow direction side toward the inner periphery side in the radial direction, and is connected to the main plate protrusion portion at an inner periphery-side end portion, and an inner peripheral wall that forms the suction port of the pump casing includes a suction port protrusion portion that is provided at a portion in a rotation direction of the rotating shaft, is disposed along the second end face with a gap from the second end face, and protrudes toward a center side of the suction port.

In the non-clogging pump according to the above aspect of the present invention, as described above, the vane portion is configured to include the first end face that is an end face in the counter-inflow direction, which is located on the outer periphery side in the radial direction of the rotating shaft, and extends in the direction intersecting the counter-inflow direction, and the second end face (a leading edge) that is an end face in the counter-inflow direction, which is connected to the first end face from the inner periphery side in the radial direction of the first end face and located on the inner periphery side in the radial direction, and is inclined with respect to the first end face so as to be located on the counter-inflow direction side toward the inner periphery side in the radial direction. In this way, it is possible to guide foreign matter sucked from the suction port to the outer periphery side of the impeller along the second end face and the first end face without providing a flow straightener having a configuration different from that of the impeller, as in the related art, and therefore, it is possible to restrain the foreign matter from being caught in the pump chamber due to the foreign matter being entangled in the impeller with the rotation of the impeller. That is, it is possible to guide the foreign matter to the outer periphery side of the impeller such that the foreign matter passes by the impeller itself without providing a flow straightener that is a dedicated configuration in which the foreign matter is easily caught, as in the related art. Further, since it is not necessary to provide a flow straightener as in the related art, the gap between a flow straightener and a pump main body (an impeller) is not clogged with soft foreign matter, and thus it is possible to improve the passage performance of the foreign matter. As a result, it is possible to improve the passage performance of the foreign matter without complicating a device configuration. Further, due to providing two or more vane portions, it is possible to dispose the two or more vane portions in a well-balanced manner around the rotating shaft, and therefore, compared to a case where only one vane portion is provided, it is possible to reduce vibration associated with the rotation of the impeller. Therefore, it is possible to suppress a decrease in pump efficiency.

Further, the main plate portion is provided with the main plate protrusion portion that protrudes in the counter-inflow direction toward the inner periphery side in the radial direction of the rotating shaft, and the suction port protrusion portion that protrudes to the center side of suction port is provided on the inner peripheral wall that forms the suction port of the pump casing. Due to the suction port protrusion portion, the center of the swirling flow (the spirally swirling flow that is generated by the rotation of the impeller) that is generated in the vicinity of the suction port can be made to be eccentric when viewed from the axial direction of the rotating shaft, and therefore, the center of the swirling flow can be shifted from the main plate protrusion portion. Further, the foreign matter can be sucked in at an angle with respect to the direction of the rotating shaft. With the above, it is possible to restrain the foreign matter from being entangled in the main plate protrusion portion. Further, the opening area of the suction port is reduced due to the suction port protrusion portion, so that it is possible to increase the suction speed of water and the foreign matter. Therefore, it is possible to suppress a decrease in suction flow velocity even in a small water volume range. Further, since it is possible to suck the foreign matter at an angle with respect to the axial direction of the rotating shaft (the inflow direction) due to the second end face (since a configuration can be made such that the foreign matter is not sucked straight with respect to the inflow direction), it is possible to allow the foreign matter to effectively flow toward the discharge port.

In the non-clogging pump according to the above aspect, preferably, an angle formed by the second end face and the first end face is an obtuse angle. With this configuration, it is possible to cause the second end face to protrude toward the suction port side with respect to the first end face, and therefore, by the second end face, it is possible to crush and cut the foreign matter (rubber gloves, stockings, or the like in a state of being caught in a tip clearance (the gap between the first end face of the vane portion and the surface of the pump casing facing the first end face)) that stays across the suction port due to being caught in the end face of the vane portion. In this way, it is possible to prevent the foreign matter from being constrained by the tip clearance across the suction port.

In the non-clogging pump according to the above aspect, preferably, the suction port protrusion portion is formed in an angular range of 45 degrees or larger around the rotating shaft when viewed from the axial direction of the rotating shaft. With this configuration, the suction port protrusion portion can be provided in a relatively large angular range, and therefore, the center of the swirling flow that is generated in the vicinity of the suction port can be reliably made to be eccentric. As a result, it is possible to effectively restrain the foreign matter from being entangled in the main plate protrusion portion. Further, since it is possible to cause the suction port protrusion portion to protrude from a relatively large angular range, the opening area of the suction port can be reduced due to the suction port protrusion portion, and thus it is possible to further increase the suction speed of water and the foreign matter. Therefore, it is possible to further suppress a decrease in suction flow velocity even in a small water volume range. Further, since the suction port protrusion portion is formed in a relatively wide angular range, it is possible to restrain soft foreign matter from being entangled in and constrained by the suction port protrusion portion.

In the non-clogging pump according to the above aspect, preferably, an inner periphery-side end portion of the suction port protrusion portion is disposed on an inner periphery side in the radial direction of the rotating shaft with respect to the inner periphery-side end portion of the vane portion that is connected to the main plate protrusion portion, or at a position substantially corresponding to the inner periphery-side end portion of the vane portion in the radial direction. With this configuration, it is possible to cause the suction port protrusion portion to protrude to the vicinity of the main plate protrusion portion, and therefore, when the vane portion passes near the suction port protrusion portion, the foreign matter can be reliably removed by the suction port protrusion portion. As a result, it is possible to restrain the foreign matter from being stacked on the second end face. Further, the foreign matter can be cut and crushed to a size in which the foreign matter is not caught in the tongue portion, the outer periphery of the vane portion, and a tip clearance.

In the non-clogging pump according to the above aspect, preferably, the main plate protrusion portion has, at a tip thereof, an inclined surface inclined with respect to a direction orthogonal to the counter-inflow direction. With this configuration, when the inclined surface rotates, a force that pushes the foreign matter to the top portion of the inclined surface along the inclined surface can be applied to the foreign matter. As a result, the force acting on the foreign matter in the inflow direction can be made non-uniform, and therefore, in a case where the foreign matter is entangled in the inclined surface, the foreign matter is out of balance and can be removed from the inclined surface. Further, even in a case where soft foreign matter is twisted, the center of the twist deviating from the rotation center axis of the rotating shaft and coming near to the top portion due to rotation and the foreign matter receiving a force that pushes it to the top portion along the inclined surface are combined, so that it becomes easy to remove the foreign matter from the suction-side end face of the impeller.

In this case, preferably, the tip of the main plate protrusion portion has a substantially circular shape when viewed from the axial direction of the rotating shaft. With this configuration, the top portion of the inclined surface is formed to be round, and therefore, the effect of removing the foreign matter from the inclined surface is enhanced.

In the configuration in which the main plate protrusion portion has the inclined surface, preferably, the inclined surface is provided on an entire tip of the main plate protrusion portion. With this configuration, when the inclined surface rotates, a larger force that pushes the foreign matter to the top portion of the inclined surface along the inclined surface can be applied to the foreign matter. Therefore, in a case where the foreign matter is entangled in the inclined surface, the balance of the foreign matter can be more greatly disturbed, and therefore, it is possible to effectively remove the foreign matter from the inclined surface.

In the configuration in which the main plate protrusion portion has the inclined surface, preferably, an apex on the counter-inflow direction side of the inclined surface is disposed at a substantially intermediate position between the two vane portions that are located in the vicinity of the apex in the rotation direction of the rotating shaft. With this configuration, both the distance between the top portion and the vane portion on one side and the distance between the top portion and the vane portion on the other side can be reduced (substantially minimized), and therefore, after the foreign matter is removed from the inclined surface, it can be quickly crushed by the vane portion and the suction port protrusion portion and pushed into the suction port. As a result, the passage performance of the foreign matter can be further improved.

In the configuration in which the main plate protrusion portion has the inclined surface, preferably, the inner periphery-side end portion in the counter-inflow direction of the suction port protrusion portion is disposed close to a side surface of the main plate protrusion portion when viewed from the axial direction of the rotating shaft. With this configuration, the main plate protrusion portion and the suction port protrusion portion can be disposed with a narrow (small) gap, and therefore, the foreign matter can be effectively cut and crushed in the gap between the main plate protrusion portion and the suction port protrusion portion, and the foreign matter can be more effectively removed from the inclined surface of the impeller.

In the configuration in which the main plate protrusion portion has the inclined surface, preferably, the inner periphery-side end portion in the counter-inflow direction of the suction port protrusion portion is disposed between an apex on the counter-inflow direction side of the inclined surface and a point that is located on a bottom on an opposite direction side to the counter-inflow direction of the inclined surface, in the axial direction of the rotating shaft. With this configuration, the side surface of the formed inclined surface has a non-uniform length in the direction of the rotating shaft, and therefore, the inner periphery-side end portion of the suction port protrusion portion and the side surface of the main plate protrusion portion smoothly repeat "approach" and "separation" with the rotation of the impeller, so that the foreign matter is easily removed from the inclined surface of the impeller. As a result, the passage performance of the foreign matter can be further improved.

In the non-clogging pump according to the above aspect, preferably, an inner periphery-side portion in the radial direction of the vane portion (of the rotating shaft) is inclined to be located so as to spread to the outer periphery side in the radial direction toward the counter-inflow direction. With this configuration, the vane portion is formed in a so-called screw shape. Therefore, a force that pushes the foreign matter into the impeller can act on the foreign matter with the rotation of the impeller, and therefore, the foreign matter is easily removed from the gap between the suction port protrusion portion and the vane portion. As a result, the passage performance of the foreign matter can be further improved.

In the non-clogging pump according to the above aspect, preferably, the pump casing has a foreign matter discharge groove that has an elongated shape, is provided on a facing surface on the counter-inflow direction side of the impeller, which faces the impeller, and extends from the inner periphery side toward the outer periphery side in the radial direction of the rotating shaft, and an end portion on the inner periphery side in the radial direction of the foreign matter discharge groove extends to the suction port protrusion portion. With this configuration, due to the foreign matter discharge groove, the constraint of the foreign matter in the gap between the first end face and the second end face of the vane portion (the impeller) and the facing surface of the pump casing, which faces the first end face and the second end face of the vane portion can be suppressed. As a result, the passage performance of the foreign matter can be further improved.

In this case, preferably, the pump casing includes the facing surface that surrounds the suction port, faces the impeller from the suction port side, and extends in a direction substantially orthogonal to the axial direction of the rotating shaft, the foreign matter discharge groove is provided on the facing surface, and the foreign matter discharge groove is provided with an edge portion, which changes an angle at which the foreign matter discharge groove extends, in the vicinity of a boundary portion between the suction port protrusion portion and the facing surface when viewed from the axial direction of the rotating shaft. With this configuration, the foreign matter is caught in the edge portion, and the vane portion of the impeller passes over the foreign matter caught in the edge portion, so that the foreign matter can be cut.

In the configuration in which the pump casing has the foreign matter discharge groove, preferably, an end portion on the outer periphery side in the radial direction of the foreign matter discharge groove is located on the outer periphery side with respect to the vane portion in the radial direction. With this configuration, due to the foreign matter discharge groove, the foreign matter can be led to the outside of the gap between the first end face of the vane portion (the impeller) and the facing surface of the pump casing, which faces the first end face of the vane portion, and therefore, the passage performance of the foreign matter can be further improved.

In the configuration in which the pump casing has the foreign matter discharge groove, preferably, the foreign matter discharge groove is configured to become deeper toward a downstream side from an upstream side in the rotation direction of the impeller along the rotation direction of the impeller. With this configuration, the foreign matter can be effectively pushed into the foreign matter discharge groove along the rotation direction of the impeller, and therefore, the passage performance of the foreign matter can be further improved.

In the configuration in which the pump casing has the foreign matter discharge groove, preferably, the foreign matter discharge groove is configured to widen in width toward an outer periphery from a center of the pump casing. With this configuration, the foreign matter discharge groove is gradually widened in the discharge direction, and therefore, the effect of pushing out the foreign matter in the discharge direction can be obtained.

In the non-clogging pump according to the above aspect, preferably, in the rotation direction of the rotating shaft, an upstream-side side surface of the suction port protrusion portion is disposed in an angular range between a tongue portion of the pump casing and an angular position on an upstream side by 120 degrees with respect to the tongue portion. With this configuration, the upstream-side side surface, which is located at a position where the foreign matter is easily pushed into the pump chamber, can be disposed at a position relatively close to the tongue portion. As a result, the sucked foreign matter can be immediately discharged with a time when it is present in the pump chamber (volute) shortened. Therefore, it is possible to make it difficult for the foreign matter to be entangled in the tongue portion, the impeller, or the like. As a result, the passage performance of the foreign matter can be further improved.

In the non-clogging pump according to the above aspect, preferably, the impeller is configured such that a flow path on a negative pressure surface side of the vane portion is narrower than a flow path on a pressure surface side of the vane portion on the main plate portion side and the inner periphery side in the radial direction. With this configuration, by narrowing the flow path on the negative pressure surface side, the stay of the sucked foreign matter in the flow path on the negative pressure surface side is suppressed, and the foreign matter can be pushed into (be brought near) the flow path on the pressure surface side. That is, it is possible to easily discharge the foreign matter. As a result, the passage performance of the foreign matter can be further improved.

In the non-clogging pump according to the above aspect, preferably, the main plate portion is provided with a weight portion having an annular shape and applying an inertial force to the impeller. With this configuration, due to a flywheel effect that is obtained by the weight portion, the inertial force of the rotating impeller can be increased, and therefore, an increase in torque due to the crushing of the foreign matter and an impact can be canceled out. The flywheel effect is an effect of making the rotation speed of a rotating body rotating around a predetermined axis as uniform as possible (an effect of eliminating unevenness of the rotation speed of the rotating body).

In the non-clogging pump according to the above aspect, preferably, a thickness on the outer periphery side in the radial direction of the vane portion is larger than a thickness on the inner periphery side in the radial direction of the vane portion. With this configuration, due to the flywheel effect that is obtained by the vane portion, the inertial force of the rotating impeller can be increased, and therefore, an increase in torque due to the crushing of the foreign matter and an impact can be canceled out. Further, it is possible to obtain the flywheel effect by the vane portion that is an existing configuration.

In the non-clogging pump according to the above aspect, preferably, the non-clogging pump further includes an electric motor that rotates the rotating shaft, in which the non-clogging pump is configured such that a rotational frequency of the electric motor is changeable, and is configured such that in a case where a drive power value of the electric motor falls below a predetermined first threshold value, the rotational frequency of the electric motor is increased until the drive power value of the electric motor reaches the predetermined first threshold value or a predetermined second threshold value exceeding the predetermined first threshold value. With this configuration, the span for crushing the foreign matter can be shortened by increasing the rotational frequency of the electric motor, and therefore, the foreign matter can be crushed finely. Further, by applying a larger centrifugal force to the passing foreign matter, it is possible to improve the action of pushing up the foreign matter on the inclined surface, and therefore, the foreign matter can be easily removed from the inclined surface of the impeller. Further, a water suction speed (suction water amount) can be increased. As a result, the passage performance of the foreign matter can be further improved.

In the configuration in which the main plate protrusion portion has the inclined surface, preferably, the non-clogging pump further includes an electric motor that rotates the rotating shaft, in which the non-clogging pump is configured such that in a case where a state where a drive power value of the electric motor exceeds a drive power reference value is continued for a predetermined time or longer, the impeller is rotated in a reverse direction when it is repeatedly determined that the state where the drive power value of the electric motor exceeds the drive power reference value is continued for a predetermined time or longer, even if restart is attempted with the electric motor stopped by a predetermined number of times. With this configuration, due to the reverse rotation of the impeller, the side surface of the main plate protrusion portion and the inner periphery-side end portion of the suction port protrusion portion repeat approach and separation with respect to the foreign matter returned to the inner periphery side of the impeller, and therefore, the non-clogging pump can effectively remove the foreign matter entangled in the impeller, the foreign matter constrained in the pump chamber, or the like.

In the non-clogging pump according to the above aspect, preferably, the inner peripheral wall that forms the suction port of the pump casing further includes, in addition to the suction port protrusion portion, a recessed portion that is provided on a side opposite to a side where the suction port protrusion portion is disposed with respect to the rotating shaft when viewed in a plan view, and is recessed to an outer periphery side in the radial direction of the suction port. With this configuration, by providing the suction port protrusion portion and the recessed portion, the center of the swirling flow that is generated in the vicinity of the suction port can be made to be more eccentric compared to a case where only the suction port protrusion portion is provided. Therefore, it is possible to further suppress the entanglement of the foreign matter in the main plate protrusion portion. As a result, the passage performance of the foreign matter can be further improved. Further, due to the recessed portion, even if large foreign matter flows in, the foreign matter is moved to the recessed portion, and the foreign matter can be crushed to a size that allows passage, by "cutting action and crushing action" due to a change in the relative position between the downstream-side side wall in the rotation direction of the recessed portion (the rotation direction of the impeller) and the pressure surface-side edge of the leading edge (the second end face) of the rotating vane portion.

Advantageous Effects of Invention

According to the present invention, as described above, it is possible to improve the passage performance of the foreign matter without complicating a device configuration.

Figure 7:
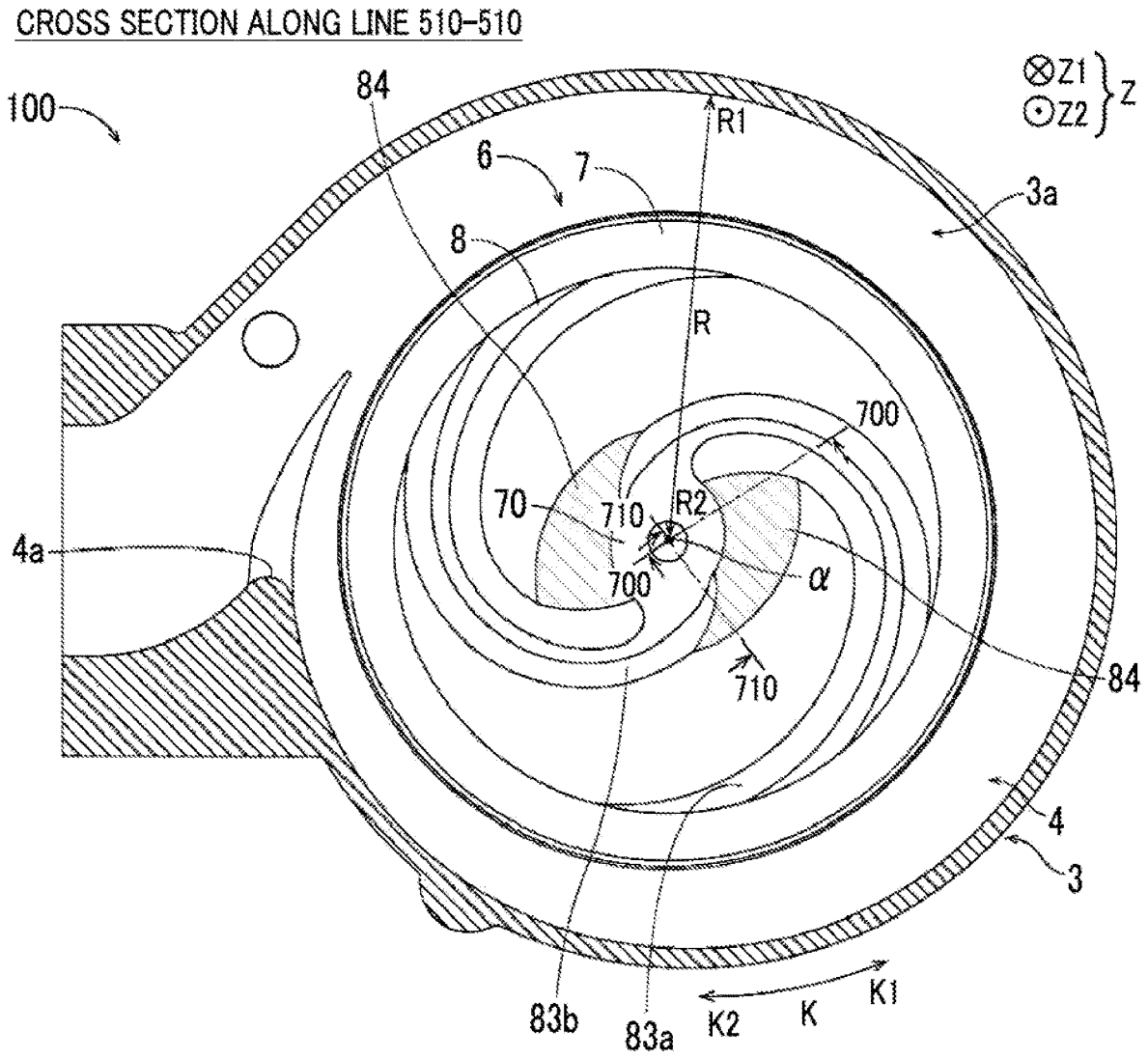
FIG. 7 is a sectional view taken along line 510-510 of FIG. 1.
Figure 8:
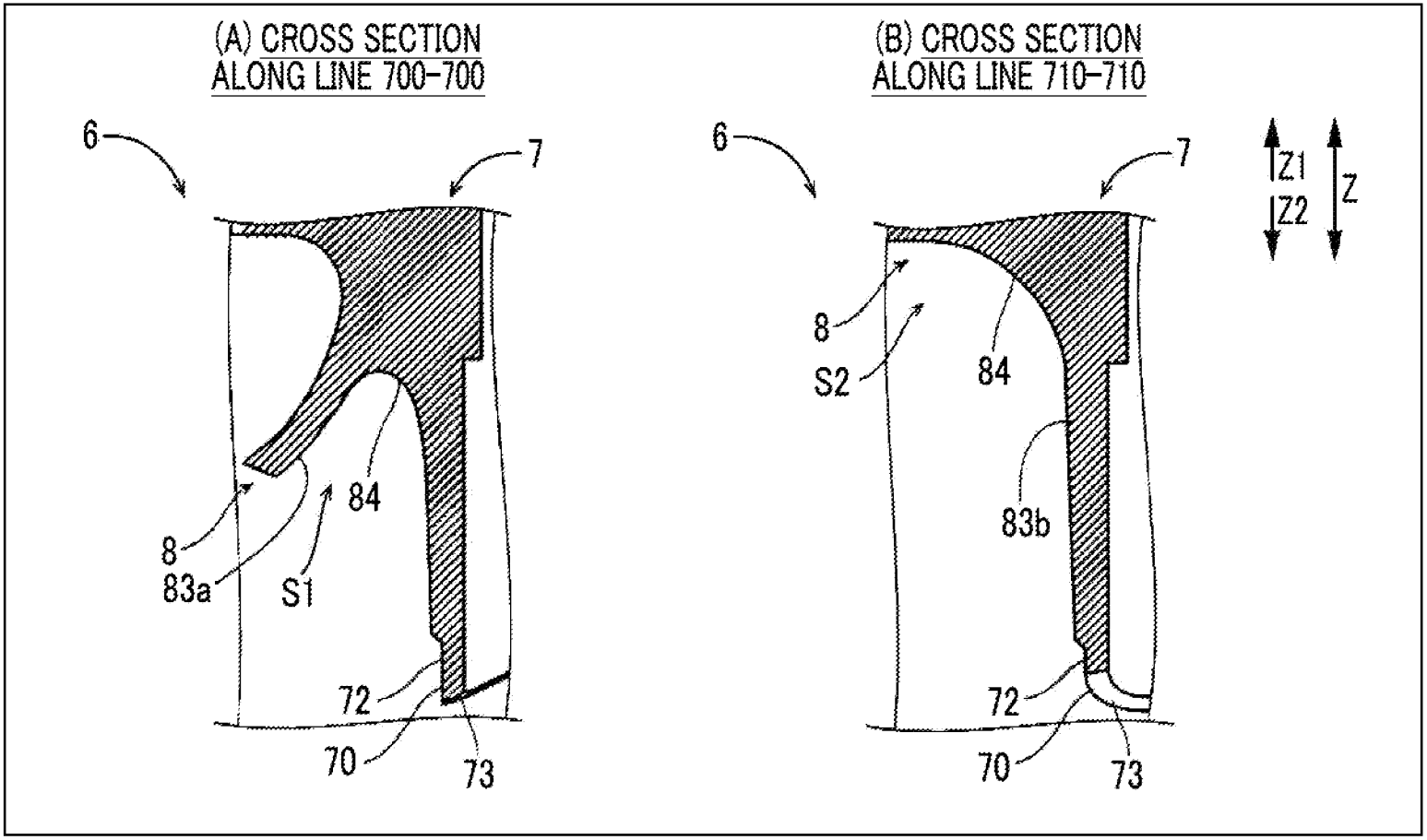

(A) of FIG. 8 is a sectional view taken along line 700-700 of FIG. 7, and (B) of FIG. 8 is a sectional view taken along line 710-710 of FIG. 7.

Figure 9:
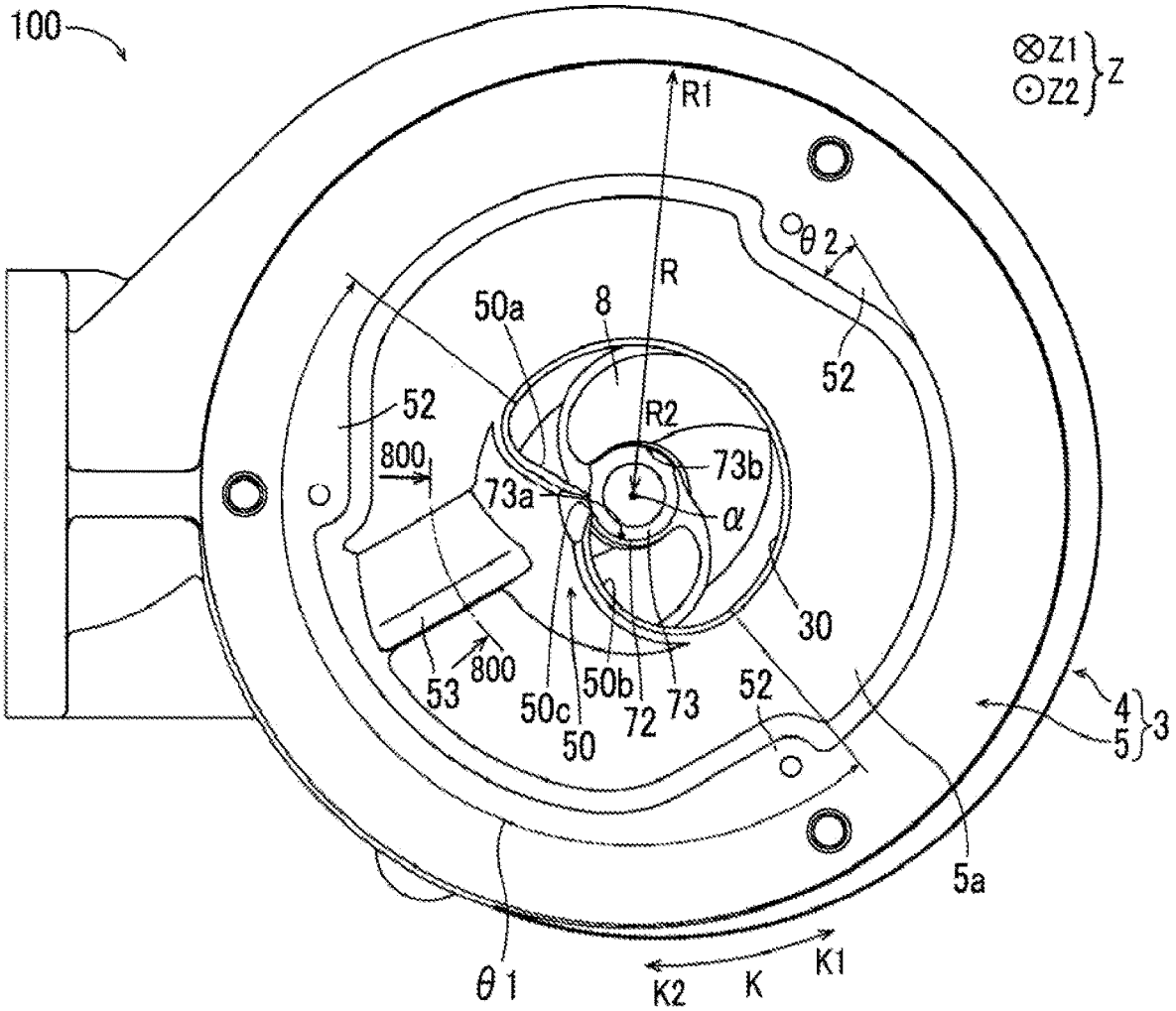

FIG. 9 is a diagram showing the non-clogging pump according to the embodiment as viewed from below.

Figure 10:
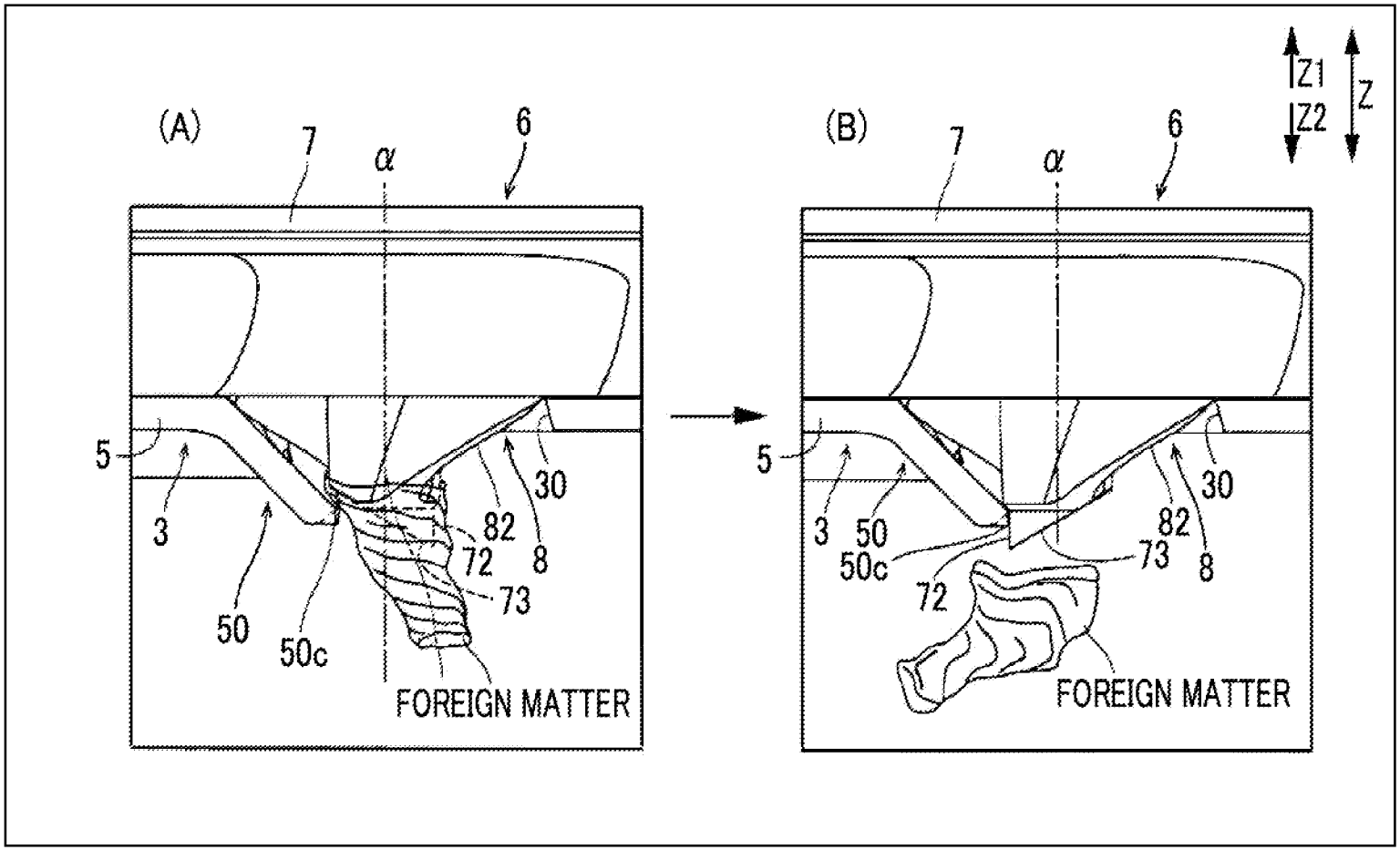

FIG. 10 is a diagram for explaining the behavior when foreign matter is entangled in an inclined surface of the non-clogging pump according to the embodiment.

Figure 11:
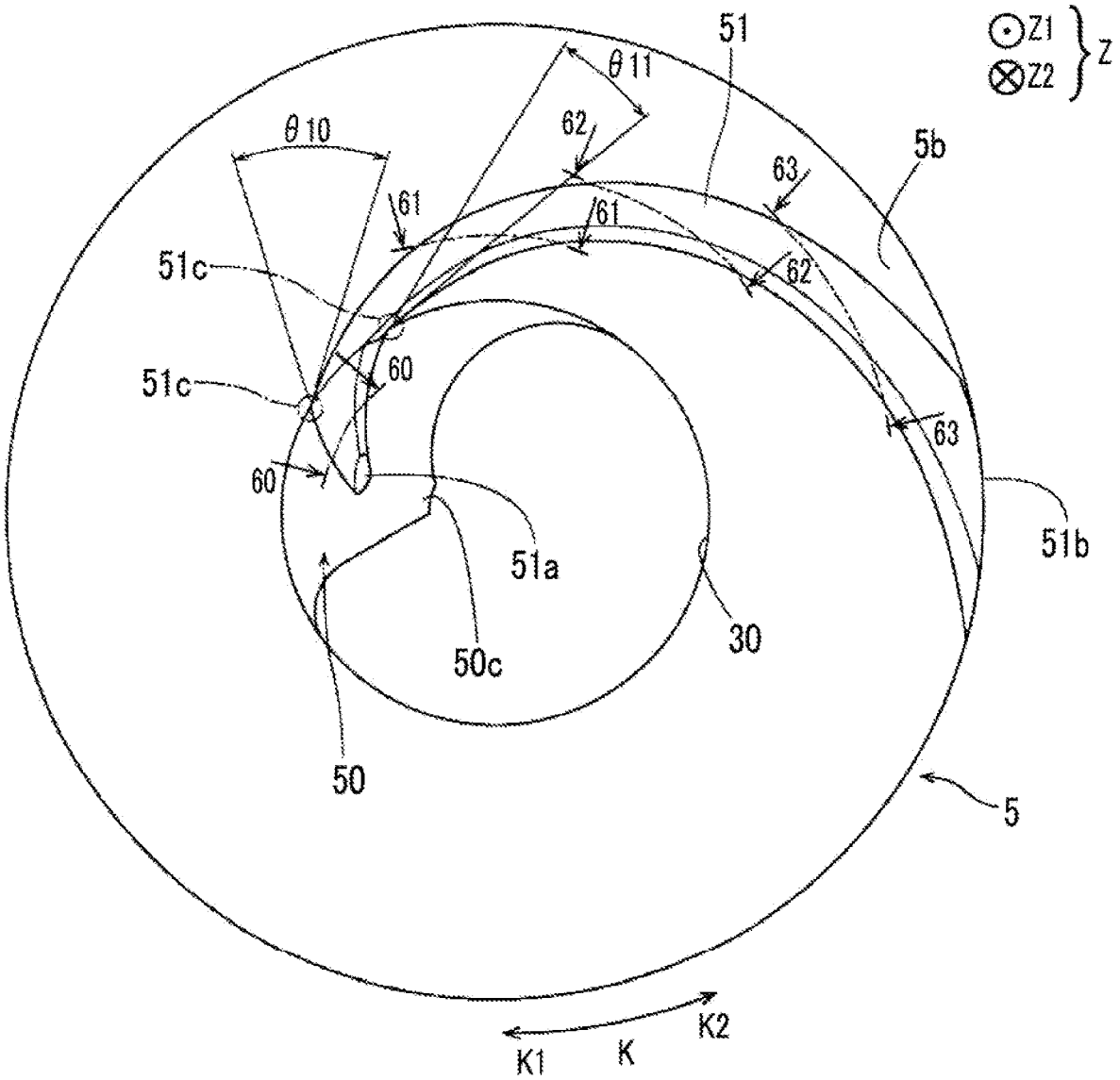

FIG. 11 is a plan view showing a suction cover provided with a foreign matter discharge groove of the non-clogging pump according to the embodiment.

Figure 12:
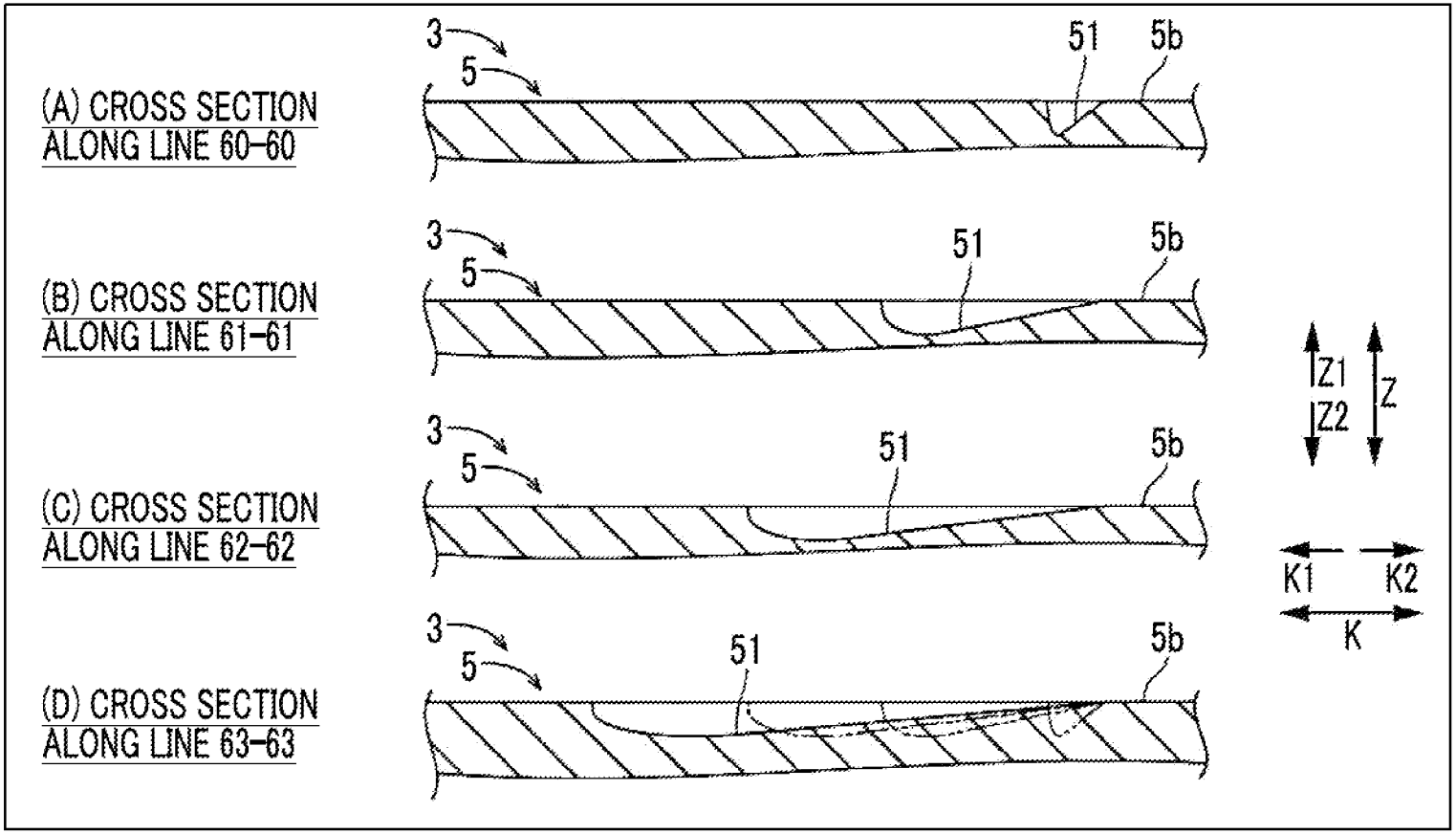

FIG. 12 is a sectional view of the foreign matter discharge groove shown in FIG. 11, in which (A) is a cross section taken along line 60-60, (B) is a cross section taken along line 61-61, (C) Is a cross section taken along line 62-62, and (D) is a cross section taken along line 63-63.

Figure 13:
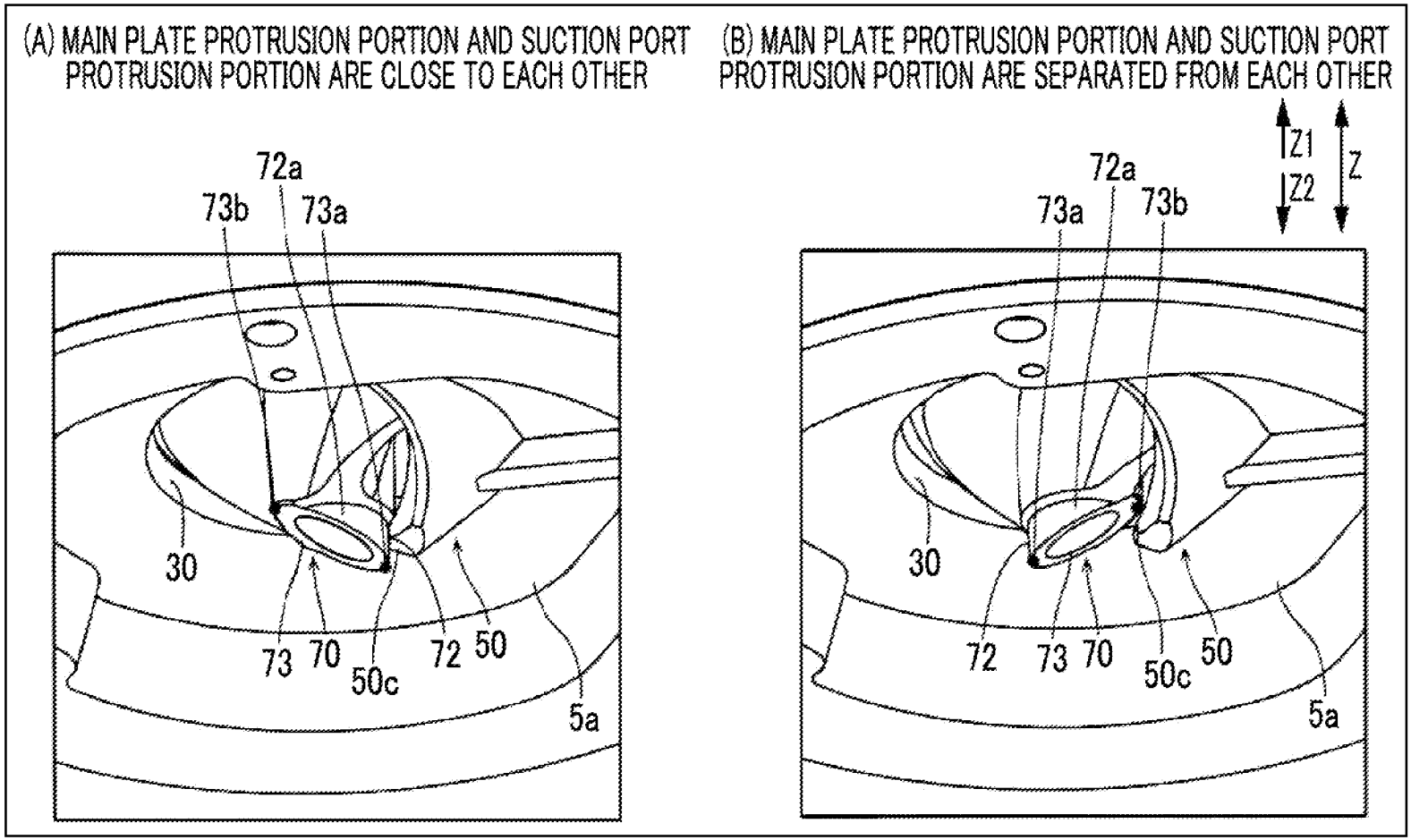

(A) of FIG. 13 is a diagram showing a state where a main plate protrusion portion and a suction port protrusion portion are close to each other, and (B) of FIG. 13 is a diagram showing a state where the main plate protrusion portion and the suction port protrusion portion are separated from each other.

Figure 14:
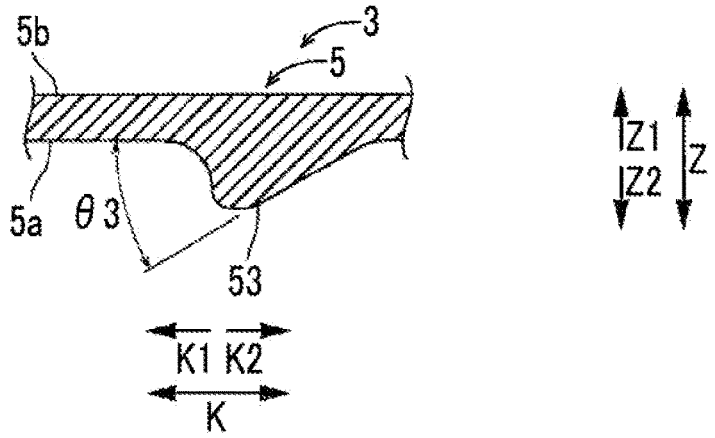

FIG. 14 is a sectional view taken along line 800-800 of FIG. 9.

Figure 15:
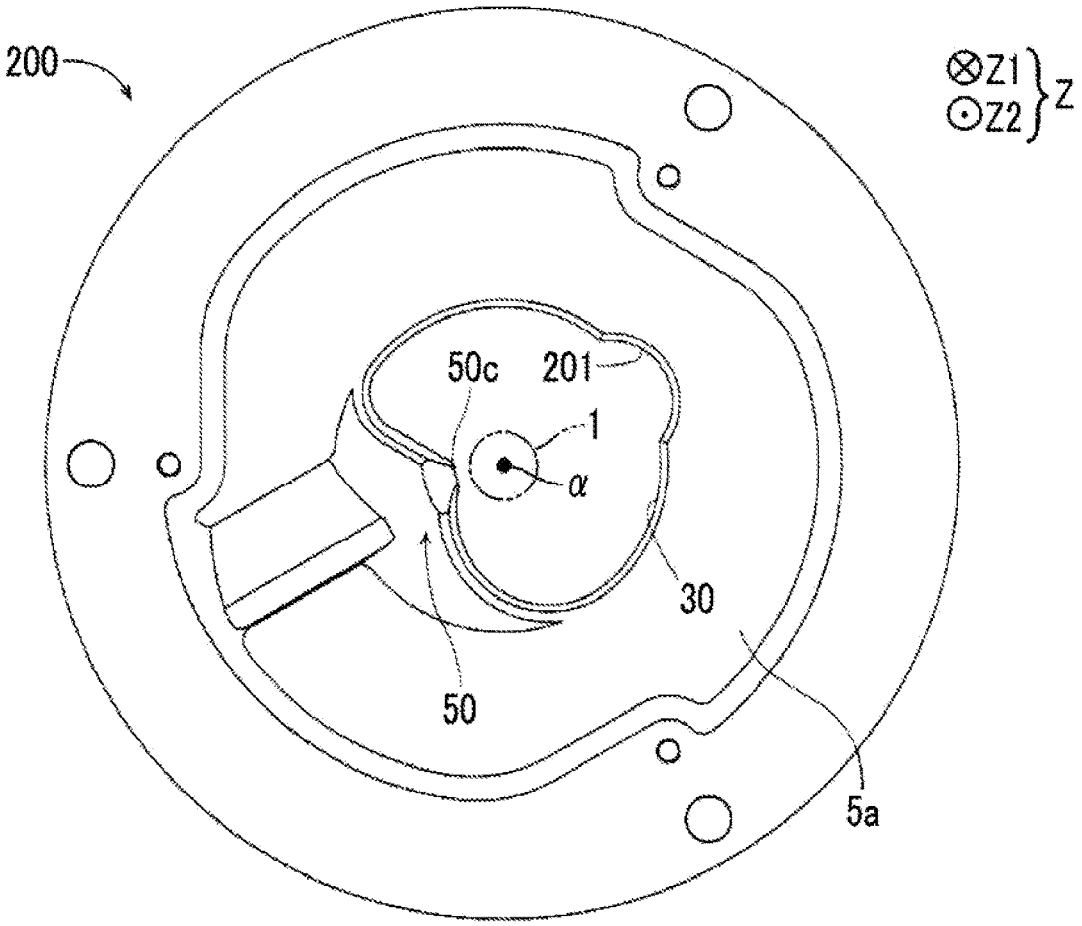

FIG. 15 is a diagram showing a non-clogging pump according to a modification example as viewed from below.

DESCRIPTION OF EMBODIMENTS

Hereinafter, an embodiment will be described based on the drawings.

(Schematic Configuration of Non-Clogging Pump)

A non-clogging pump 100 of an embodiment will be described with reference to FIGS. 1 to 14. The non-clogging pump 100 is a vertical type submersible electric pump in which a rotating shaft 1 extends in an up-down direction (a Z direction).

Figure 1:
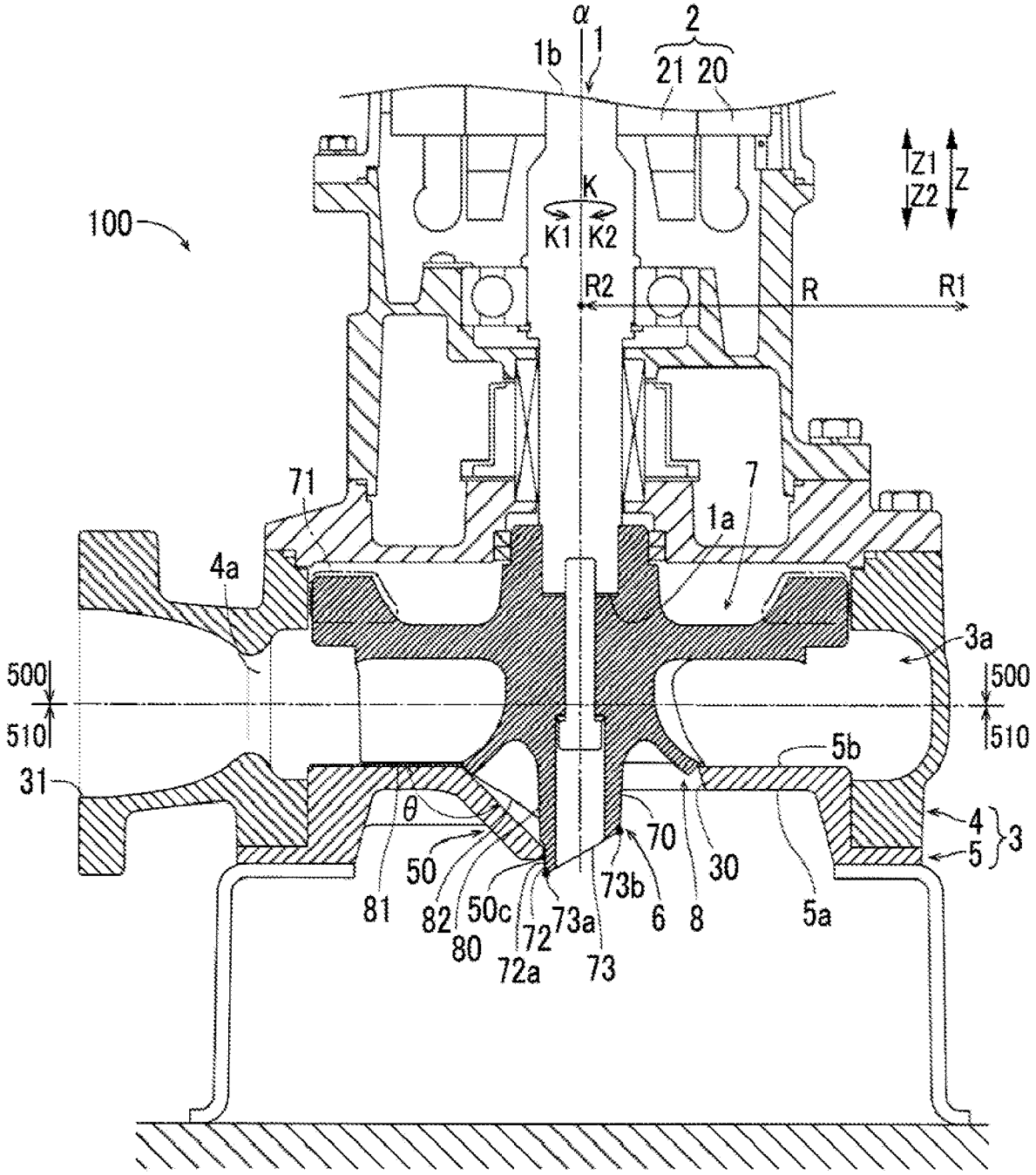
FIG. 1 is a sectional view schematically showing a non-clogging pump according to an embodiment.

As shown in FIG. 1, the non-clogging pump 100 includes the rotating shaft 1, an electric motor 2, a pump casing 3, and an impeller 6.

Here, the non-clogging pump 100 of the present embodiment is configured to allow even relatively long and wide soft foreign matter (contaminant) (soft foreign matter) or the like, such as a towel, stockings, rubber gloves, bandages, or diapers, to pass (be sucked from a suction port 30 of the pump casing 3 and discharged from a discharge port 31 of the pump casing 3) without clogging.

Further, the non-clogging pump 100 is usually used such that the flow velocity in a discharge pipe (not shown) that is disposed on the downstream side of the discharge port 31 is equal to or higher than the flow velocity (for example, 0.6 m/s) at which it is difficult for a sediment to accumulate in the discharge pipe, and is equal or lower than the flow velocity (for example, 3.0 m/s) at which a pipe wall or painting in the discharge pipe is not damaged. As an example, the non-clogging pump 100 is used such that the flow velocity in the discharge pipe is about 1.8 m/s.

(Schematic Configuration of Each Portion of Non-Clogging Pump)

The rotating shaft 1 has a columnar shape extending in the up-down direction. The impeller 6 is fixed to one end 1*a* (a lower end) of the rotating shaft 1, and the electric motor (a rotor 21) is fixed to the other end 1*b* (upper end) side.

Here, in each drawing, an axial direction of the rotating shaft 1 is indicated by the Z direction. In the Z directions, the direction (upward direction) from one end 1*a* toward the other end 1*b* is indicated by a Z1 direction, and the direction (upward direction) from the other end 1*b* toward one end 1*a* is indicated by a Z2 direction.

An inflow direction in the suction port 30 of the pump casing 3 is a direction that (substantially) coincides with the axial direction of the rotating shaft 1 (the Z1 direction from one end 1*a* toward the other end 1*b*). Further, a counter-inflow direction, which is the direction opposite to the inflow direction in the suction port 30 of the pump casing 3, is also a direction that (substantially) coincides with the axial direction of the rotating shaft 1 (the Z2 direction from the other end 1*b* toward one end 1*a*).

Further, in each drawing, a radial direction of the rotating shaft 1 is indicated by an R direction. In the R direction, a direction from the inner periphery side toward the outer periphery side is indicated by an R1 direction, and a direction from the outer periphery side toward the inner periphery side is indicated by an R2 direction.

Further, in each drawing, a rotation direction of the impeller 6 (the rotating shaft 1) is indicated by a K1 direction, and a reverse rotation direction of the impeller 6 is indicated by a K2 direction. The rotation direction of the impeller 6 is also the rotation direction of the rotating shaft 1. The rotation direction (the K1 direction) of the impeller 6 is a counterclockwise direction when viewed from the lower side (the Z2 direction side). However, in a case where the impeller 6 (described later) is rotated in the reverse direction, the rotation direction of the impeller 6 is the K2 direction.

The electric motor 2 is configured to rotate the rotating shaft 1. Then, the electric motor 2 is configured to rotate the impeller 6 through the rotating shaft 1. Specifically, the electric motor 2 includes a stator 20 having a coil and a rotor 21 disposed on the inner periphery side of the stator 20. The rotating shaft 1 is fixed to the rotor 21. The electric motor 2 is configured to rotate the rotating shaft 1 together with the rotor 21 by generating a magnetic field by the stator 20. As a result, the impeller 6 rotates.

The electric motor 2 is configured such that a rotational frequency thereof can be changed by changing a drive power value of the electric motor 2 by the non-clogging pump 100. The non-clogging pump 100 is configured to increase the rotational frequency of the electric motor 2 until the drive power value of the electric motor 2 reaches a predetermined first threshold value or a predetermined second threshold value exceeding the predetermined first threshold value, in a case where the drive power value of the electric motor 2 falls below the predetermined first threshold value. In this way, in a case where the drive power value of the electric motor 2 falls below the predetermined first threshold value, so that the flow rate of the non-clogging pump 100 is reduced (in the case of a small water volume range), it is possible to increase (return) the flow velocity. The predetermined first threshold value and the predetermined second threshold value can be changed by setting.

Further, the non-clogging pump 100 is configured to rotate the impeller 6 in the reverse direction in a case where the foreign matter is entangled in the impeller 6 or the foreign matter is constrained in a pump chamber 3*a*. Specifically, the non-clogging pump 100 is configured such that in a case where a state where the drive power value of the electric motor 2 exceeds the drive power reference value is continued for a predetermined time or longer, the impeller 6 is rotated in the reverse direction (the K2 direction) when it is repeatedly determined that the state where the drive power value of the electric motor 2 exceeds the drive power reference value is continued for a predetermined time or longer, even if restart is attempted with the electric motor stopped by a predetermined number of times. In this way, the impeller 6 having a vane portion 8 that spirally spreads rotates in the reverse direction, so that a side surface 72*a* of a main plate protrusion portion 70 (a tubular portion 72) and an inner periphery-side end portion 50*c* of a suction port protrusion portion 50 repeat approach and separation with respect to the foreign matter returned to the inner periphery side of the impeller 6, and therefore, the non-clogging pump 100 can effectively remove the foreign matter entangled in the impeller 6, the foreign matter constrained in the pump chamber 3*a*, or the like. The predetermined time and the predetermined number of times can be changed by setting.

Figure 2:
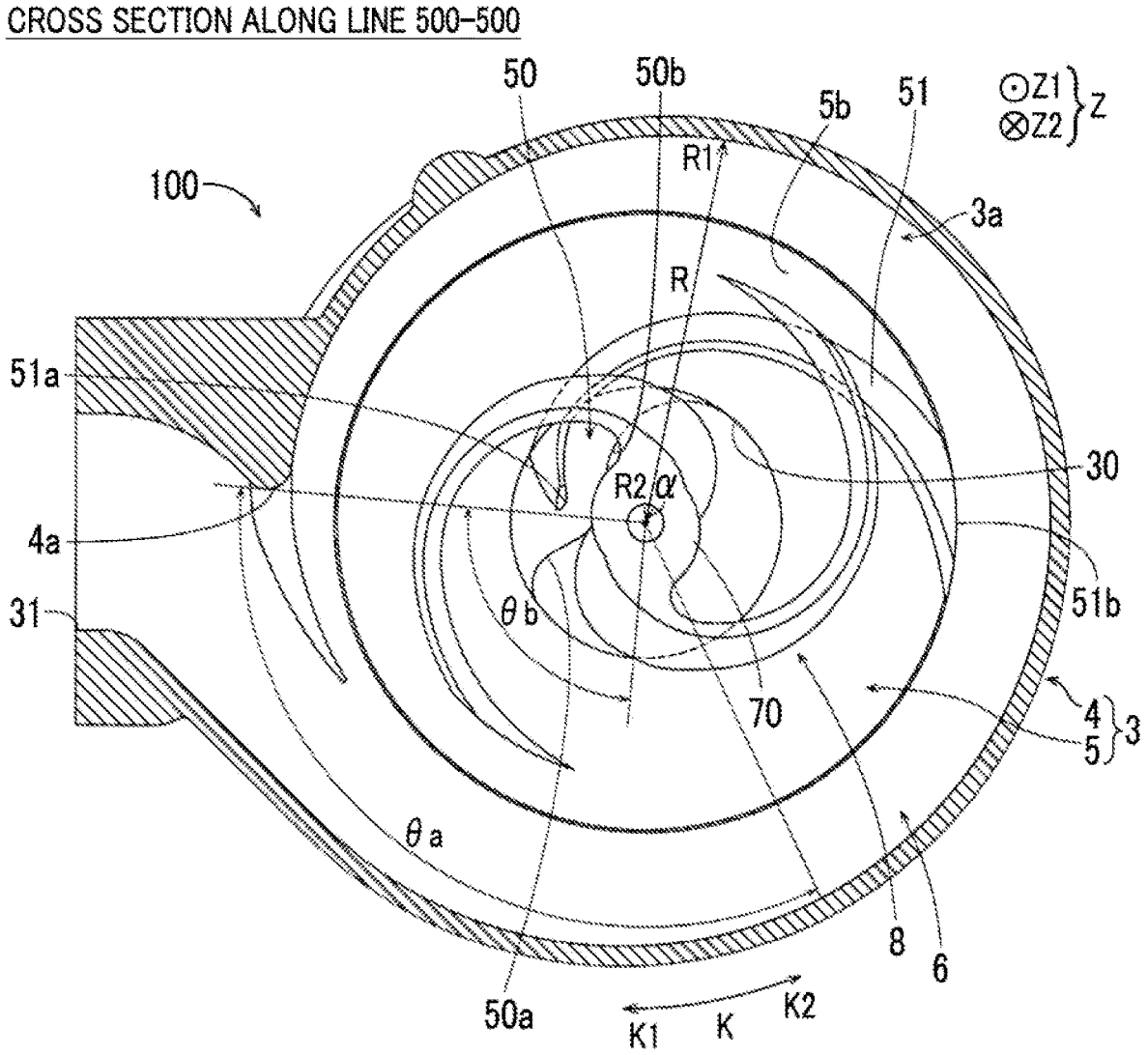
FIG. 2 is a sectional view taken along line 500-500 of FIG. 1.

As shown in FIG. 2, in the pump casing 3, the impeller 6 is disposed in the pump chamber 3*a* inside thereof. The pump chamber 3*a* is formed in a volute shape. The pump casing 3 is provided with a tongue portion 4*a* at a corner portion between the space where the impeller 6 is disposed and the space on the discharge port 31 side. The tongue portion 4*a* is a portion that protrudes to the inside of the pump casing 3 to divide a flow path when viewed from the Z direction (described later).

Figure 3:
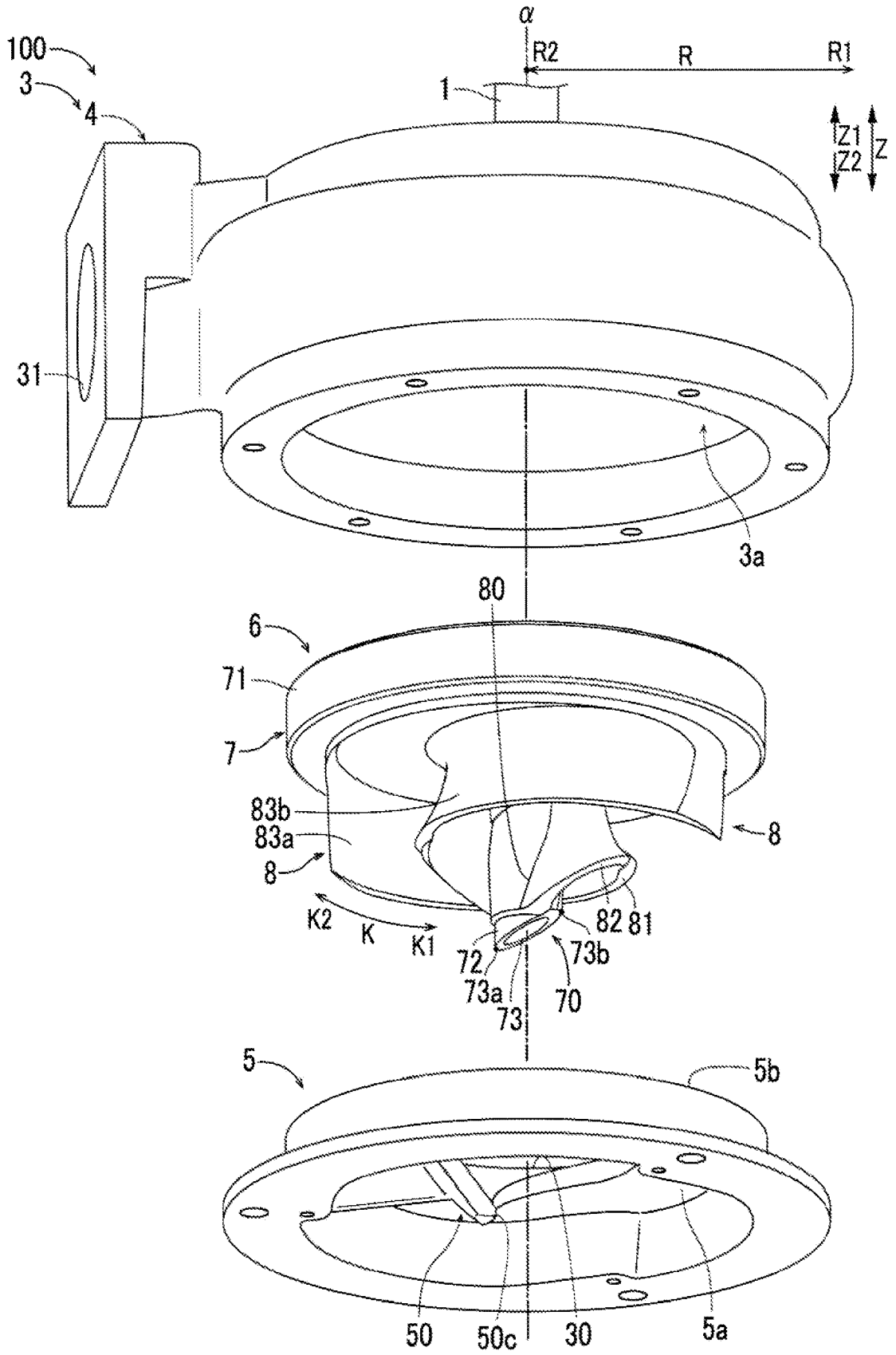
FIG. 3 is an exploded perspective view of the non-clogging pump according to the embodiment.

As shown in FIG. 3, the pump casing 3 includes a pump casing main body 4 and a suction cover 5 that is detachably installed to the pump casing main body 4 from below. The pump casing main body 4 is provided with the discharge port 31 that is located at the most downstream of the pump casing 3. The suction cover 5 is provided with the suction port 30 that is located at the most upstream of the pump casing 3.

(Configuration of Impeller)

The impeller 6 is a so-called semi-open type impeller. The impeller 6 is disposed inside the pump casing 3. The impeller 6 includes a main plate portion 7 (a shroud) and two vane portions 8 (vanes) that are disposed on the suction port 30 side (the lower side) of the main plate portion 7.

The two vane portions 8 are disposed evenly when viewed from the Z direction so as to be rotationally symmetric with respect to a rotation center axis a of the rotating shaft 1. That is, the impeller 6 is configured such that in a case where the vane portion 8 on one side rotates 180 degrees around the rotation center axis a of the rotating shaft 1, the vane portion 8 on one side overlaps the vane portion 8 on the other side. Therefore, the impeller 6 is configured such that a fluid reaction force acts on the vane portion 8 on one side and the vane portion 8 on the other side in a well-balanced manner during rotation. That is, the impeller 6 is configured to be able to rotate stably.

As shown in FIG. 1, the main plate portion 7 includes the main plate protrusion portion 70 that protrudes in the counter-inflow direction (the Z2 direction) toward the inner periphery side that is the center side of the main plate portion 7 (the rotation center axis a side of the rotating shaft 1).

Figure 4:
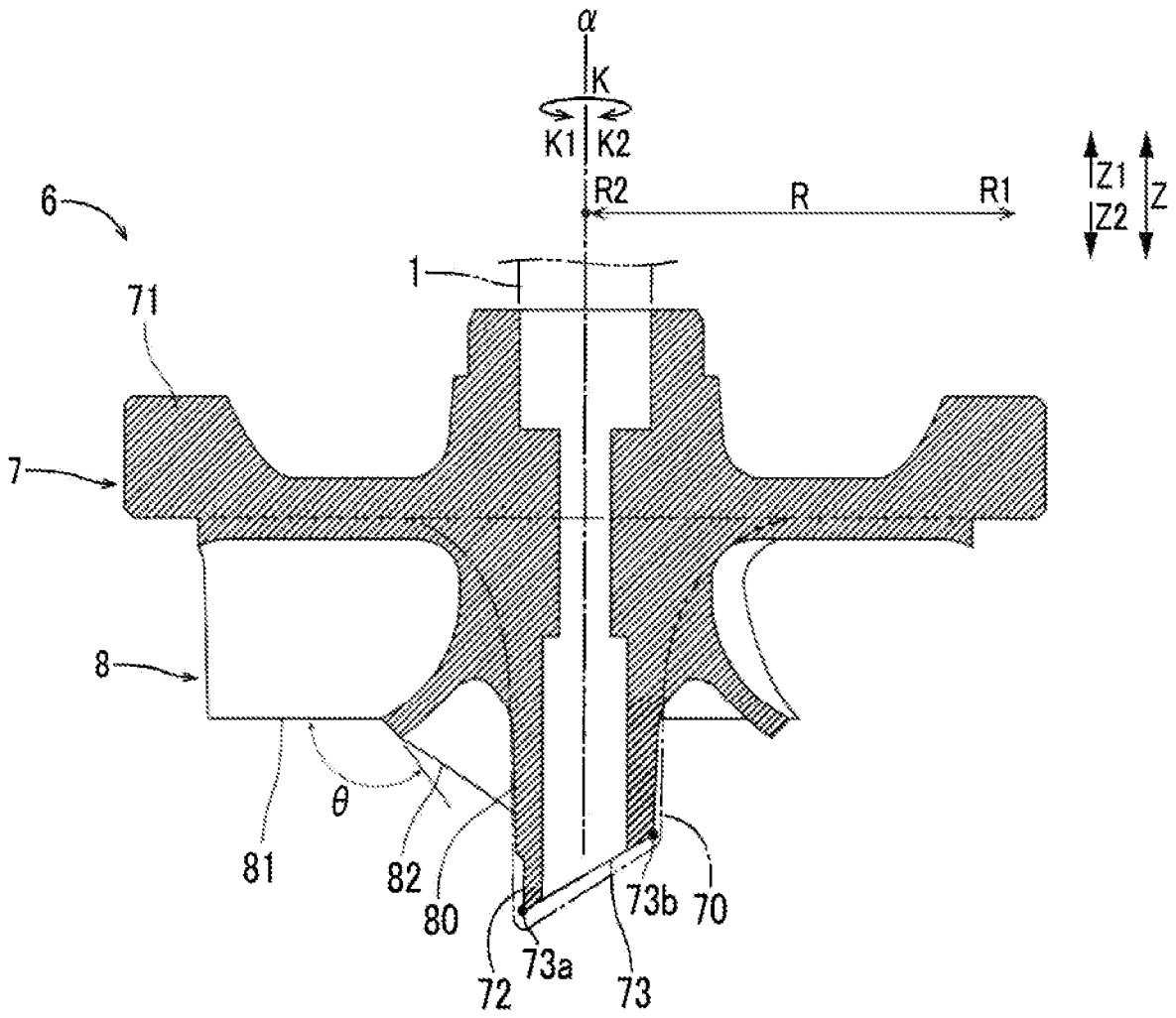
FIG. 4 is a diagram showing only an impeller in each configuration shown in FIG. 1.

Specifically, as shown in FIG. 4, the main plate portion (the main plate protrusion portion 70) is formed in a mountain shape whose center side protrudes downward. The main plate portion 7 has the main plate protrusion portion 70 provided only at the inner periphery-side portion. The upper-side portion of the main plate portion 7 is formed in a flat plate shape extending in a substantially horizontal direction. The lowermost portion (the end portion in the counter-inflow direction) of the main plate portion 7 is located in the counter-inflow direction (the downward direction) (the Z2 direction) with respect to the suction port 30. That is, the main plate protrusion portion 70 (the impeller 6) protrudes to the outside of the pump casing 3 through the suction port 30.

The vane portion 8 is connected to the main plate protrusion portion 70 at an inner periphery-side end portion 80. The vane portion 8 includes a first end face 81 and a second end face 82 (a leading edge) connected to the first end face 81 from the inner periphery side in the radial direction (the R direction) of the first end face 81.

Referring to FIG. 1 again, the first end face 81 is an end face in the counter-inflow direction (the Z2 direction). The first end face 81 is located on the outer periphery side in the radial direction (the R direction). The first end face extends in a direction intersecting the counter-inflow direction. As an example, the first end face 81 extends in a substantially horizontal direction. That is, the first end face 81 is a surface substantially orthogonal to the axial direction of the rotating shaft 1 (the Z direction). Further, the first end face 81 is disposed close to a facing surface 5*b* (an upper surface) of the suction cover 5 (described later), and extends along the facing surface 5*b* of the suction cover 5.

The second end face 82 is an end face in the counter-inflow direction (the Z2 direction). The second end face 82 is located on the inner periphery side in the radial direction (the R direction). The second end face 82 is connected to the main plate protrusion portion 70 at the innermost periphery-side portion thereof. The second end face 82 is inclined with respect to the first end face 81 so as to be located in the counter-inflow direction (the downward direction) (the Z2 direction) toward the inner periphery side in the radial direction.

As an example, the inclination angle of the second end face 82 (the leading edge) is about 45 degrees with respect to the horizontal plane. That is, the vane portion 8 is formed such that the inner periphery side (the center side) in the radial direction (the R direction) protrudes downward, similarly to the main plate protrusion portion 70.

Figure 5:
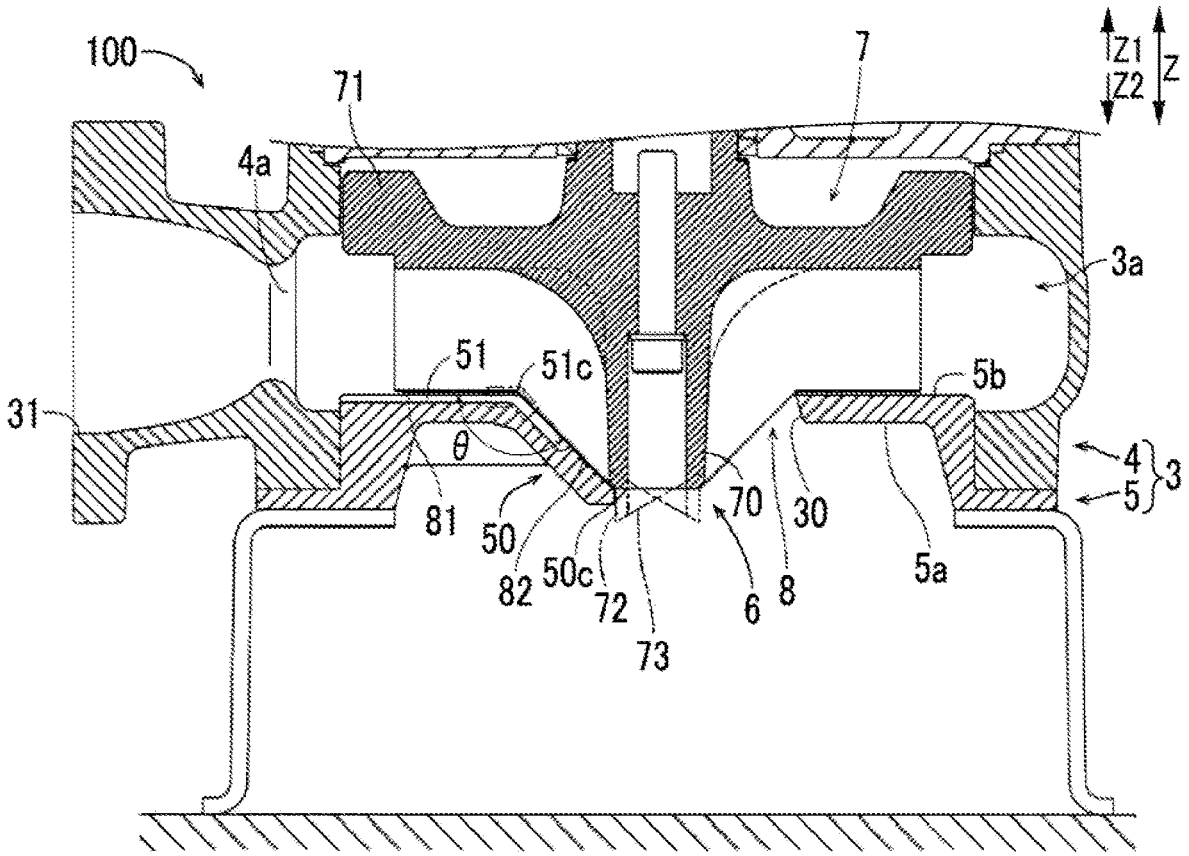
FIG. 5 is a sectional view schematically showing the non-clogging pump according to the embodiment and is a diagram in which the impeller and a foreign matter discharge groove are projected along a rotation direction.

Referring to FIG. 5 in which the impeller 6 and a foreign matter discharge groove 51 (described later) are projected along the rotation direction, as described above, since the first end face 81 extends in a substantially horizontal direction and the second end face 82 is inclined with respect to the first end face 81 so as to be located in the counter-inflow direction (the downward direction) (the Z2 direction) toward the inner periphery side in the radial direction, an angle θ between the first end face 81 and the second end face 82 is an obtuse angle. As an example, when the inclination angle of the second end face 82 (the leading edge) is about 45 degrees with respect to the horizontal plane, the angle θ between the first end face 81 and the second end face 82 is about 135 degrees. In FIG. 5, a cutting range (cutting location) of the foreign matter by an edge portion 51*c* of the foreign matter discharge groove 51, which will be described later, is shown by a frame of a one-dot chain line.

Figure 6:
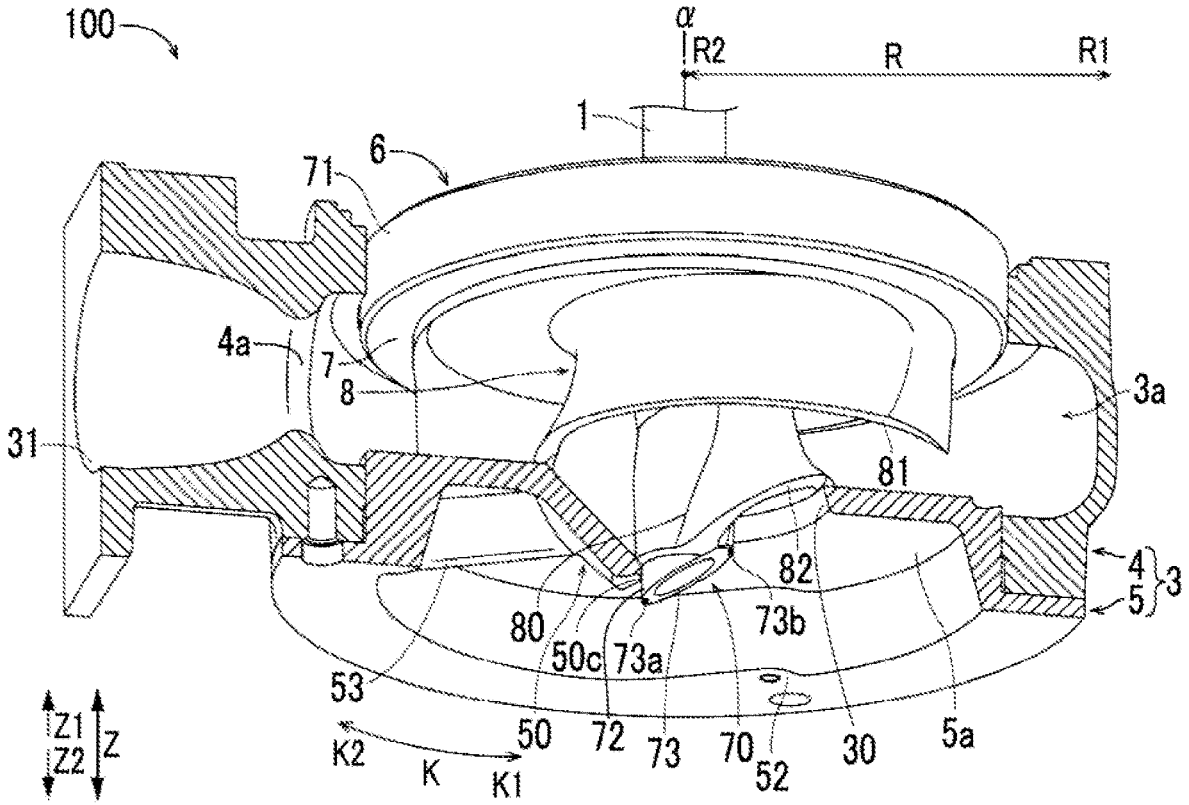
FIG. 6 is a perspective view showing a state where the impeller is disposed in a pump casing of the non-clogging pump according to the embodiment.

As shown in FIGS. 3 and 6, in the vane portion 8, the inner periphery-side portion (the portion on the rotation center axis a side of the rotating shaft 1) is formed in a diagonal flow shape. The diagonal flow shape is a so-called screw shape. Specifically, the inner periphery-side portion of the vane portion 8 is inclined to be located so as to spread to the outer periphery side in the radial direction (the R direction) toward the counter-inflow direction.

That is, the inner periphery-side portion of the vane portion 8 does not extend straight (linearly) toward the lower side (the counter-inflow direction) (the Z2 direction). The inner periphery-side portion of the vane portion 8 is curved so as to warp to the outer periphery side toward the counter-inflow direction. In this manner, in the non-clogging pump 100, the vane portion 8 is formed in a diagonal flow shape, so that a mechanical and fluid force that is directed in the inflow direction (upward direction) (the Z1 direction) is applied to the foreign matter sucked from the suction port in association with the rotation of the impeller 6, and thus the foreign matter can be effectively pushed to the downstream side.

As shown in FIGS. 7 and 8, the impeller 6 is configured such that on the main plate portion 7 side and the inner periphery side (the rotation center axis a side of the rotating shaft 1), a flow path S1 (refer to FIG. 8) on the negative pressure surface 83*a* side of the vane portion 8 is narrower than a flow path S2 (refer to FIG. 8) on the pressure surface 83*b* side of the vane portion 8.

Specifically, an R-shape portion 84 (a curved portion) is provided on the main plate portion 7 side and the inner periphery side (the rotation center axis a side of the rotating shaft 1) of the impeller 6. The R-shape portion 84 is configured to smoothly connect the main plate protrusion portion 70 and the negative pressure surface 83*a* and the pressure surface 83*b* connected to the main plate protrusion portion 70 when viewed from below. The R-shape portion 84 is provided only in the vicinity of the main plate protrusion portion 70 when viewed from below.

In the R-shape portion 84, the portion on the negative pressure surface 83*a* side is formed to have a larger curvature than the portion on the pressure surface 83*b* side. That is, the R-shape portion 84 is formed so as to be located closer to the counter-inflow direction (the downward direction) (the Z2 direction) side such that the narrower flow path S1 is formed on the negative pressure surface 83*a* side than the pressure surface 83*b* side.

The impeller 6 is provided with two configurations for stably rotating the impeller 6 by giving a flywheel effect to the impeller 6. Hereinafter, the configurations will be described in order.

As shown in FIG. 1 (FIG. 4), as a first configuration for giving the flywheel effect, a weight portion 71 that applies an inertial force to the impeller 6 is provided in the main plate portion 7. The weight portion 71 is provided on the upper portion (the portion on the Z1 direction side) of the main plate portion 7 and the outer periphery side in the radial direction (the R direction). The weight portion 71 is formed in an annular shape surrounding the rotation center axis a of the rotating shaft 1. As an example, the thickness of the weight portion 71 is formed to be twice the thickness of the main plate portion 7. The weight portion 71 may have a configuration in which it is formed of the same material as the main plate portion 7 and provided integrally with the main plate portion 7, or may have separate configuration in which it is formed of a material different from that of the main plate portion 7 and installed (fixed) to the main plate portion 7.

As shown in FIG. 7, as a second configuration for giving the flywheel effect, the vane portion 8 is formed such that the weight of the portion on the outer periphery side in the radial direction (the R direction) is heavier than that of the portion on the inner periphery side in the radial direction (the R direction). Specifically, the vane portion 8 is formed such that the thickness on the outer periphery side is larger than the thickness on the inner periphery side. The thickness of the vane portion 8 is formed so as to gradually increase toward the outer periphery side from the inner periphery side. In short, the vane portion 8 is formed so as to gradually become thicker toward the outer periphery side from the inner periphery side. As an example, the thickness of the vane portion 8 on the outer periphery side is formed to be 1.5 times the thickness on the inner periphery side.

The impeller 6 can achieve the stabilization of the speed at the time of rotation by the two configurations that give the flywheel effect described above. In this way, the non-clogging pump 100 can cancel out an impact and a torque rise which are generated at the time of crushing of the foreign matter, and can suppress an increase in a current value and the occurrence of vibration in the pump operation.

As shown in FIGS. 1 and 6, the main plate protrusion portion 70 has a portion made thinner at the lower end thereof. Specifically, in the main plate protrusion portion 70, a tubular portion 72 having a cylindrical shape and extending in the Z direction is provided at the end portion thereof in the counter-inflow direction (the downward direction) (the Z2 direction). The tubular portion 72 has a smaller diameter than the portion above the tubular portion 72. Therefore, a step is formed between the tubular portion 72 and the main plate protrusion portion 70 above the tubular portion 72. The tubular portion 72 is a portion that is disposed in a height range that overlaps the suction port protrusion portion 50 (described later) and is disposed adjacent to the vicinity of the suction port protrusion portion 50 (the inner periphery-side end portion 50*c*). When viewed from the axial direction of the rotating shaft 1 (the Z direction) (the downward direction), the outer surface of the tubular portion 72 is disposed on the inner periphery side (the rotation center axis a side of the rotating shaft 1) (the R2 direction side) with respect to the inner periphery-side end portion 80 of the vane portion 8 which is connected to the main plate protrusion portion 70.

The tubular portion 72 (the main plate protrusion portion 70) has, at the tip thereof, an inclined surface 73 inclined with respect to the direction orthogonal to the counter-inflow direction (the horizontal plane). In short, the tubular portion 72 (the main plate protrusion portion 70) generally has a shape such that the tip thereof is diagonally cut so as to have an elliptical cut end. Therefore, the inclined surface 73 is not provided at one point (a range corresponding thereto) in the axial direction of the rotating shaft 1 (the Z direction), but is provided in a predetermined range in the axial direction of the rotating shaft 1 (the Z direction). As an example, the inclination angle of the inclined surface 73 with respect to the horizontal plane is smaller than 45 degrees. As a more detailed example, the inclination angle of the inclined surface 73 with respect to the horizontal plane is 30 degrees.

As shown in FIG. 9, the tip (the tubular portion 72) of the main plate protrusion portion 70 has a substantially circular shape when viewed from the axial direction of the rotating shaft 1 (the Z direction) (the downward direction). When viewed from the axial direction of the rotating shaft 1 (the Z direction) (the downward direction), the center of the inclined surface 73 substantially coincides with the rotation center axis a of the rotating shaft 1. The inclined surface 73 is provided on the entire tip of the main plate protrusion portion 70. The entire inclined surface 73 is disposed below the suction port 30 (excluding the suction port protrusion portion 50) (refer to FIG. 1).

An apex 73*a* (an end point on the lower side) on the counter-inflow direction side of the inclined surface 73 is disposed at a substantially intermediate position between the two vane portions 8 (a pair of vane portions 8) which are located in the vicinity of the apex 73*a* in the rotation direction of the rotating shaft 1 (the K1 direction). That is, in the rotation direction of the rotating shaft 1 (the K1 direction), the two vane portions 8 (a pair of vane portions 8) are disposed at angular positions shifted by 90 degrees to one side and the other side of the apex 73*a*.

Here, the non-clogging pump 100 is configured to disturb the balance of the foreign matter and facilitate suction by applying a force for pushing the foreign matter toward the apex 73*a* side along the inclined surface 73.

Further, as shown stepwise in (A) and (B) of FIG. 10, the non-clogging pump 100 is configured such that in a case where soft foreign matter is entangled in the inclined surface 73 outside the pump chamber 3*a*, the entangled soft foreign matter can be removed by shifting a rotation axis of the soft foreign matter twisted by the inclined surface 73 from the rotation center axis a of the rotating shaft 1 by a centrifugal force.

(Configuration of Pump Casing)

As shown in FIG. 9, the pump casing 3 includes the pump casing main body 4 and the suction cover 5 provided with the suction port 30, as described above.

Here, the suction port is generally formed in a circular shape when viewed from below. However, the suction port 30 of the present embodiment is formed in a shape different from the circular shape. The suction port 30 of the present embodiment is formed by an arc and a portion protruding to (located on) the inner periphery side in the radial direction from the arc, when viewed from below.

Specifically, the inner peripheral wall that forms the suction port 30 includes the suction port protrusion portion 50 provided at a portion thereof in the rotation direction of the rotating shaft 1. The suction port protrusion portion 50 is disposed along the second end face 82 (the leading edge) of the vane portion 8 with a slight gap from the second end face 82. The suction port protrusion portion 50 is inclined along the inclined second end face 82 of the impeller 6 and protrudes toward the inner periphery side (the center side) in the radial direction of the suction port 30 (refer to FIG. 1). The suction port protrusion portion 50 protrudes toward the rotating shaft 1 when viewed from below. As an example, in a case where the inclination angle of the second end face 82 with respect to the horizontal plane is about 45 degrees, the inclination angle of the suction port protrusion portion 50 is about 45 degrees with respect to the horizontal plane (refer to FIGS. 1 and 4). That is, the inclination angle of the suction port protrusion portion 50 is substantially the same as the inclination angle of the second end face 82.

The suction port protrusion portion 50 is formed in an angular range θ1 of 45 degrees or larger around the rotating shaft 1 when viewed from the axial direction of the rotating shaft 1 (the Z direction). More specifically, the suction port protrusion portion 50 is formed in the angular range θ1 of 90 degrees or larger around the rotating shaft 1 when viewed from the axial direction of the rotating shaft 1 (the Z direction).

The suction port protrusion portion 50 has two curved side surfaces (edge portions) that bulge outward when viewed from the Z direction. Hereinafter, the side surface located on the upstream side, out of the two side surfaces of the suction port protrusion portion 50, will be described as an upstream-side side surface 50*a*, and the side surface located on the downstream side will be described as a downstream-side side surface 50*b*.

The upstream-side side surface 50*a* is configured to overlap the rotating vane portion 8 prior to the downstream-side side surface 50*b* when viewed from the Z direction. As an example, the inner periphery-side end portion 50*c* of the suction port protrusion portion 50, to which the upstream-side side surface 50*a* and the downstream-side side surface 50*b* are connected, is formed so as to be an arc of a concentric circle centered on the rotation center axis a.

In the space interposed between the upstream-side side surface 50*a* and the vane portion 8, a push-in force from the outside toward the inside of the pump chamber 3*a* is generated due to the rotating vane portion 8. The non-clogging pump 100 is configured to suck the foreign matter from between the upstream-side side surface 50*a* and the rotating vane portion 8 by utilizing the push-in force.

As shown in FIG. 1, the inner periphery-side end portion 50*c* of the suction port protrusion portion 50 is disposed on the inner periphery side in the radial direction (the R direction) with respect to the inner periphery-side end portion 80 of the vane portion 8 which is connected to the main plate protrusion portion 70 of the impeller 6. That is, the inner periphery-side end portion 50*c* of the suction port protrusion portion 50 is disposed at a position closer to the rotation center axis a of the rotating shaft 1 than the inner periphery-side end portion 80 of the vane portion 8.

The inner periphery-side end portion 50*c* (the lower end) in the counter-inflow direction of the suction port protrusion portion 50 is disposed between the apex 73*a* (an end point on the lower side) on the counter-inflow direction side of the inclined surface 73 of the impeller 6 and a point 73*b* (an end point of the upper side) that is located at the bottom on the opposite direction side to the counter-inflow direction of the inclined surface 73, in the axial direction of the rotating shaft 1 (the Z direction).

The inner periphery-side end portion 50*c* in the counter-inflow direction of the suction port protrusion portion 50 is disposed close to the main plate protrusion portion 70 (the tubular portion 72). That is, the inner periphery-side end portion 50*c* of the suction port protrusion portion 50 is disposed with a slight gap between itself and the tubular portion 72. Therefore, the inner periphery-side end portion 50*c* in the counter-inflow direction of the suction port protrusion portion 50 alternately repeats approach (a distance becomes relatively small) and separation (a distance becomes relatively large) with respect to the tubular portion having an inclined surface 73 when the impeller 6 (the tubular portion 72 having the inclined surface 73) rotates (refer to FIG. 13).

The term "approach" refers to a state where the side surface 72*a* of the tubular portion 72 of the impeller 6 and the inner periphery-side end portion 50*c* of the suction port protrusion portion 50 face each other in the horizontal direction at a predetermined rotation position of the impeller 6. The term "separation" refers to a state where the inclined surface 73 of the impeller 6 and the inner periphery-side end portion 50*c* of the suction port protrusion portion 50 face each other in the horizontal direction at a predetermined rotation position of the impeller 6. In short, the gap between the inner periphery-side end portion 50*c* of the suction port protrusion portion 50 and the impeller 6 in the horizontal direction is alternately extended and reduced in association with the rotation of the impeller 6.

At the rotation position in the approach state shown in (A) of FIG. 13, the suction port protrusion portion 50 is disposed at a position closer to the apex 73*a* (the end point on the lower side) on the counter-inflow direction side of the inclined surface 73 of the impeller 6 than the point 73*b* (the end point on the upper side) located on the bottom on the opposite direction side to the counter-inflow direction of the inclined surface 73 in the direction (the horizontal direction) orthogonal to the axial direction of the rotating shaft 1 (refer to FIG. 1).

On the other hand, at the rotation position in the separation state shown in (B) of FIG. 13, the suction port protrusion portion 50 is disposed at a position closer to the point 73*b* than the apex 73*a* in the direction (the horizontal direction) orthogonal to the axial direction of the rotating shaft 1 (refer to FIG. 1).

As shown in FIG. 2, in the rotation direction of the rotating shaft 1, the upstream-side side surface 50*a* of the suction port protrusion portion 50 is disposed in an angular range ea between the tongue portion 4*a* of the pump casing 3 and the angular position on the upstream side (the upstream side in a flow direction of water in the pump chamber 3*a*) by 120 degrees from the tongue portion 4*a*.

Therefore, the non-clogging pump 100 is configured to be capable of sucking the foreign matter from the vicinity of the upstream-side side surface 50*a* of the suction port protrusion portion 50 disposed at a position relatively close to the tongue portion 4*a* through the suction port 30. As a result, the non-clogging pump 100 can transport the sucked foreign matter to the discharge port 31 through a path of a relatively short distance.

In the rotation direction of the rotating shaft 1, the upstream-side side surface 50*a* of the suction port protrusion portion 50 is more preferably disposed in an angular range θb between the tongue portion 4*a* of the pump casing 3 and the angular position on the upstream side (the upstream side in the flow direction of water in the pump chamber 3*a*) by 90 degrees from the tongue portion 4*a*. With this configuration, it becomes possible to transport the sucked foreign matter to the discharge port 31 through a path of a shorter distance.

As shown in FIG. 2 (FIG. 11), the pump casing 3 (the suction cover 5) has the foreign matter discharge groove 51. The foreign matter discharge groove 51 is provided on the facing surface 5*b* (the upper surface) on the counter-inflow direction side (the Z2 direction side) of the impeller 6, which faces the impeller 6. The foreign matter discharge groove 51 has an elongated shape extending from the inner periphery side in the radial direction (the R direction) toward the outer periphery side.

As shown in (A) to (D) of FIG. 12, the foreign matter discharge groove 51 has a shape in which the cross section in the circumferential direction is half of a substantially teardrop shape. The foreign matter discharge groove 51 is formed so as to gradually increase in the rotation direction (the K1 direction) of the impeller 6 from the inner periphery side in the radial direction toward the outer periphery side. That is, the foreign matter discharge groove 51 is formed such that the width of the foreign matter discharge groove 51 increases and R of the bottom surface becomes gentle from the inner periphery side in the radial direction toward the outer periphery side.

As shown in FIG. 11, the pump casing 3 (the suction cover 5) includes the facing surface 5*b* that surrounds the suction port 30, faces the impeller 6 from the suction port side, and extends in the direction substantially orthogonal to the axial direction of the rotating shaft 1. The foreign matter discharge groove 51 is provided in the facing surface 5*b*. In the foreign matter discharge groove 51, the edge portion 51*c* that changes the angle at which the foreign matter discharge groove 51 extends is provided in the vicinity of the boundary portion between the suction port protrusion portion 50 and the facing surface 5*b* when viewed from the axial direction of the rotating shaft 1.

The edge portion 51*c* on the upstream side in the rotation direction of the impeller changes from the upstream side toward the downstream side by an angle of a predetermined angle θ10 with respect to a tangent line to the foreign matter discharge groove 51 formed in the suction port protrusion portion 50 when viewed from the axial direction of the rotating shaft 1. The edge portion 51*c* on the downstream side in the rotation direction of the impeller changes from the upstream side toward the downstream side by an angle of a predetermined angle θ11 with respect to a tangent line to the foreign matter discharge groove 51 formed in the suction port protrusion portion 50 when viewed from the axial direction of the rotating shaft 1. As an example, the predetermined angle θ10 is 32.5 degrees and the predetermined angle θ11 is 21.2 degrees.

As shown in FIG. 2 (FIG. 11), an end portion 51*a* on the inner periphery side in the radial direction of the foreign matter discharge groove 51 extends to the suction port protrusion portion 50. An end portion 51*b* on the outer periphery side in the radial direction of the foreign matter discharge groove 51 is located on the outer periphery side with respect to the vane portion 8 in the radial direction (the R direction). That is, the foreign matter discharge groove 51 extends to the outer periphery side with respect to the gap (slight gap) between the vane portion 8 where a constraint occurs and the facing surface 5*b* of the suction cover 5 in the radial direction (the R direction). The foreign matter discharge groove 51 extends from the inner periphery side in the radial direction (the R direction) toward the outer periphery side so as to swirl along the rotation direction (the K1 direction) of the impeller 6.

Specifically, the foreign matter discharge groove 51 has a curved shape along the flow direction of a swirling flow that is generated in the pump chamber 3*a* with the rotation of the rotating shaft 1 (a swirling spiral flow that is generated with the rotation of the impeller 6). As an example, in the present embodiment, only one foreign matter discharge groove 51 is provided in the pump casing 3. The foreign matter discharge groove 51 has a function of restraining the foreign matter from being constrained between the vane portion 8 and the pump casing 3. Therefore, the non-clogging pump 100 can reliably transport the foreign matter through the discharge port 31 by the foreign matter discharge groove 51.

The foreign matter discharge groove 51 is configured to gradually become deeper along the rotation direction of the impeller 6 toward the downstream side from the upstream side in the rotation direction of the impeller 6.

As shown in FIGS. 9 and 13, the outer portion on the lower side of the suction port 30 of the pump casing 3 (the suction cover 5) is formed in a smooth shape along the flow of the swirling flow so as not to obstruct the flow of the swirling flow.

Specifically, the suction cover 5 is provided with a recessed portion 5*a* that is recessed from below to above. The recessed portion 5*a* is disposed in the lower portion of the suction cover 5 (on the outer side of the pump chamber 3*a*). The recessed portion 5*a* surrounds the suction port 30.

The recessed portion 5*a* is provided with a plurality of first protrusion portions 52 that protrude toward the inner periphery side in the radial direction (the R direction) when viewed from below. The first protrusion portion 52 is formed in order to secure an installation location for a member for mounting the suction cover 5 to the pump casing main body 4. As an example, the first protrusion portions 52 are disposed at equal angular intervals (120 degree intervals) in the circumferential direction of the rotating shaft 1.

In the first protrusion portion 52, the upstream side in the rotation direction is inclined at a relatively small angle θ2 with respect to the outer peripheral surface of the recessed portion 5*a* when viewed from below. As an example, the first protrusion portion 52 is inclined at an angle θ2 of degrees or smaller in the rotation direction of the impeller 6 with respect to the outer peripheral surface of the recessed portion 5*a* when viewed from below. As a more specific example, the first protrusion portion 52 is inclined at an angle θ2 of 28 degrees with respect to the outer peripheral surface of the recessed portion 5*a* when viewed from below. With such a configuration, a gentle angle is provided with respect to the rotation direction K1, and therefore, it is possible to restrain the foreign matter from getting caught.

Further, the recessed portion 5*a* is provided with a second protrusion portion 53 that extends in the radial direction and protrudes downward, when viewed from below. The second protrusion portion 53 is disposed between the outer peripheral surface of the recessed portion 5*a* and the suction port protrusion portion 50 so as to connect the outer peripheral surface of the recessed portion 5*a* and the suction port protrusion portion 50. The second protrusion portion 53 is formed in a rib shape. By forming the second protrusion portion 53 in this manner, it is possible to improve the strength of the suction port protrusion portion 50.

In the second protrusion portion 53, the upstream side in the rotation direction is inclined at a relatively small angle θ3 with respect to the bottom surface (the surface on the upper side) of the recessed portion 5*a* when viewed from below. As an example, the second protrusion portion 53 is inclined at an angle θ3 of 30 degrees or smaller with respect to the bottom surface of the recessed portion 5*a* when viewed from below. As a more specific example, the second protrusion portion 53 is inclined at an angle θ3 of 30 degrees with respect to the bottom surface of the recessed portion 5*a* when viewed from below. With such a configuration, a gentle angle is provided with respect to the rotation direction K1, and therefore, it is possible to restrain the foreign matter from getting caught.

Effects of Embodiment

In the present embodiment, the following effects can be obtained.

In the present embodiment, as described above, the vane portion 8 is configured to include the first end face 81 that is an end face in the counter-inflow direction (the Z2 direction), which is located on the outer periphery side in the radial direction (the R direction) of the rotating shaft 1, and extends in the direction intersecting the counter-inflow direction, and the second end face 82 (the leading edge) that is an end face in the counter-inflow direction, which is connected to the first end face 81 from the inner periphery side in the radial direction of the first end face and located on the inner periphery side in the radial direction, and is inclined with respect to the first end face 81 so as to be located on the counter-inflow direction side toward the inner periphery side in the radial direction. In this way, it is possible to guide the foreign matter sucked from the suction port 30 to the outer periphery side of the impeller 6 along the second end face 82 and the first end face 81 without providing a flow straightener having a configuration different from that of the impeller 6, as in the related art, and therefore, it is possible to restrain the pump chamber 3*a* from being clogged with the foreign matter due to the foreign matter being entangled in the impeller 6 with the rotation of the impeller 6. That is, it is possible to guide the foreign matter to the outer periphery side of the impeller 6 such that the foreign matter passes by the impeller 6 itself without providing a flow straightener that is a dedicated configuration in which the foreign matter is easily caught, as in the related art. Further, since it is not necessary to provide a flow straightener as in the related art, the gap between a flow straightener and a pump main body (an impeller) is not clogged with soft foreign matter, and thus it is possible to improve the passage performance of the foreign matter. As a result, it is possible to improve the passage performance of the foreign matter without complicating a device configuration. Further, due to providing the two or more vane portions 8, it is possible to dispose the two or more vane portions 8 in a well-balanced manner around the rotating shaft 1, and therefore, compared to a case where only one vane portion 8 is provided, it is possible to reduce vibration associated with the rotation of the impeller 6. Therefore, it is possible to suppress a decrease in pump efficiency.

Further, the main plate portion 7 is provided with the main plate protrusion portion 70 that protrudes in the counter-inflow direction toward the inner periphery side in the radial direction of the rotating shaft 1, and the suction port protrusion portion 50 that protrudes to the center side of suction port 30 is provided on the inner peripheral wall that forms the suction port 30 of the pump casing 3. Due to the suction port protrusion portion 50, the center of the swirling flow (the spirally swirling flow that is generated by the rotation of the impeller 6) that is generated in the vicinity of the suction port 30 can be made to be eccentric when viewed from the axial direction of the rotating shaft 1, and therefore, the center of the swirling flow can be shifted from the main plate protrusion portion 70. Further, the foreign matter can be sucked in at an angle with respect to the direction of the rotating shaft. With the above, it is possible to restrain the foreign matter from being entangled in the main plate protrusion portion 70. Further, the opening area of the suction port 30 is reduced due to the suction port protrusion portion 50, so that it is possible to increase the suction speed of water and the foreign matter. Therefore, it is possible to suppress a decrease in suction flow velocity even in a small water volume range. Further, since it is possible to suck the foreign matter at an angle with respect to the axial direction of the rotating shaft 1 (the inflow direction) due to the second end face 82 (since a configuration can be made such that the foreign matter is not sucked straight with respect to the inflow direction), it is possible to allow the foreign matter to effectively flow toward the discharge port 31.

In the present embodiment, as described above, the angle formed by the second end face 82 and the first end face 81 is an obtuse angle. In this way, it is possible to cause the second end face 82 to protrude toward the suction port 30 side with respect to the first end face 81, and therefore, by the second end face 82, it is possible to crush and cut the foreign matter (rubber gloves, stockings, or the like in a state of being caught in a tip clearance (a gap between the first end face 81 of the vane portion 8 and the surface of the pump casing 3 facing the first end face 81)) that stays across the suction port 30 due to being caught in the end face of the vane portion 8. In this way, it is possible to prevent the foreign matter from being constrained by the tip clearance across the suction port 30.

In the present embodiment, as described above, the suction port protrusion portion 50 is formed in an angular range of 45 degrees or larger around the rotating shaft 1 when viewed from the axial direction of the rotating shaft 1. In this way, the suction port protrusion portion 50 can be provided in a relatively large angular range, and therefore, the center of the swirling flow that is generated in the vicinity of the suction port 30 can be reliably made to be eccentric. As a result, it is possible to effectively restrain the foreign matter from being entangled in the main plate protrusion portion 70. Further, since it is possible to cause the suction port protrusion portion 50 to protrude from a relatively large angular range, the opening area of the suction port 30 can be reduced due to the suction port protrusion portion 50, and thus it is possible to further increase the suction speed of water and the foreign matter. Therefore, it is possible to further suppress a decrease in suction flow velocity even in a small water volume range. Further, since the suction port protrusion portion 50 is formed in a relatively wide angular range, it is possible to restrain soft foreign matter from being entangled in and constrained by the suction port protrusion portion 50.

In the present embodiment, as described above, the inner periphery-side end portion 50*c* of the suction port protrusion portion 50 is disposed on an inner periphery side in the radial direction of the rotating shaft 1 with respect to the inner periphery-side end portion 80 of the vane portion 8, which is connected to the main plate protrusion portion 70, or a position substantially corresponding to the inner periphery-side end portion 80 of the vane portion 8 in the radial direction. In this way, it is possible to cause the suction port protrusion portion 50 to protrude to the vicinity of the main plate protrusion portion 70, and therefore, when the vane portion 8 passes near the suction port protrusion portion 50, the foreign matter can be reliably removed by the suction port protrusion portion 50. As a result, it is possible to prevent the foreign matter from being stacked on the second end face 82. Further, the foreign matter can be cut and crushed to a size in which the foreign matter is not caught in the tongue portion 4*a*, the outer periphery of the vane portion 8, and the tip clearance.

In the present embodiment, as described above, the main plate protrusion portion 70 has, at a tip thereof, the inclined surface 73 inclined with respect to the direction orthogonal to the counter-inflow direction. In this way, when the inclined surface 73 rotates, a force that pushes the foreign matter to the top portion of the inclined surface 73 along the inclined surface 73 can be applied to the foreign matter. As a result, the force acting on the foreign matter in the inflow direction can be made non-uniform, and therefore, in a case where the foreign matter is entangled in the inclined surface 73, the foreign matter is out of balance and can be removed from the inclined surface 73. Further, even in a case where soft foreign matter is twisted, the center of the twist deviating from the rotation center axis of the rotating shaft 1 and coming near to the top portion due to rotation and the foreign matter receiving a force that pushes it to the top portion along the inclined surface 73 are combined, so that it becomes easy to remove the foreign matter from the suction-side end face of the impeller 6.

In the present embodiment, as described above, the tip of the main plate protrusion portion 70 has a substantially circular shape when viewed from the axial direction of the rotating shaft 1. In this way, the top portion of the inclined surface 73 is formed to be round, and therefore, the effect of removing the foreign matter from the inclined surface 73 is enhanced.

In the present embodiment, as described above, the inclined surface 73 is provided on the entire tip of the main plate protrusion portion 70. In this way, when the inclined surface 73 rotates, a larger force that pushes the foreign matter to the top portion of the inclined surface 73 along the inclined surface 73 can be applied to the foreign matter. Therefore, in a case where the foreign matter is entangled in the inclined surface 73, the balance of the foreign matter can be more greatly disturbed, and therefore, it is possible to effectively remove the foreign matter from the inclined surface 73.

In the present embodiment, as described above, the apex 73*a* on the counter-inflow direction side of the inclined surface 73 is disposed at a substantially intermediate position between the two vane portions 8 that are located in the vicinity of the apex 73*a* in the rotation direction of the rotating shaft 1. In this way, both the distance between the top portion and the vane portion 8 on one side and the distance between the top portion and the vane portion 8 on the other side can be reduced (substantially minimized), and therefore, after the foreign matter is removed from the inclined surface 73, it can be quickly crushed by the vane portion 8 and the suction port protrusion portion 50 and pushed into the suction port 30. As a result, the passage performance of the foreign matter can be further improved.

In the present embodiment, as described above, the inner periphery-side end portion 50*c* in the counter-inflow direction of the suction port protrusion portion 50 is disposed close to the side surface of the main plate protrusion portion 70 when viewed from the axial direction of the rotating shaft 1. In this way, the main plate protrusion portion 70 and the suction port protrusion portion 50 can be disposed with a narrow (small) gap, and therefore, the foreign matter can be effectively cut and crushed in the gap between the main plate protrusion portion 70 and the suction port protrusion portion 50, and the foreign matter can be more effectively removed from the inclined surface 73 of the impeller 6.

In the present embodiment, as described above, the inner periphery-side end portion 50*c* in the counter-inflow direction of the suction port protrusion portion 50 is disposed between the apex 73*a* on the counter-inflow direction side of the inclined surface 73 and the point 73*b* that is located on the bottom on the opposite direction side to the counter-inflow direction of the inclined surface 73, in the axial direction of the rotating shaft 1. With this configuration, the side surface of the formed inclined surface 73 has a non-uniform length in the direction of the rotating shaft (the Z direction), and therefore, the inner periphery-side end portion 50*c* of the suction port protrusion portion 50 and the side surface 72*a* of the main plate protrusion portion 70 (the tubular portion 72) smoothly repeat "approach" and "separation" with the rotation of the impeller 6, so that the foreign matter is easily removed from the inclined surface 73 of the impeller 6. As a result, the passage performance of the foreign matter can be further improved.

In the present embodiment, as described above, the inner periphery-side portion in the radial direction (of the rotating shaft 1) of the vane portion 8 is inclined to be located so as to spread to the outer periphery side in the radial direction toward the counter-inflow direction. In this way, the vane portion 8 is formed in a so-called screw shape. Therefore, a force that pushes foreign matter into the impeller 6 can act on the foreign matter with the rotation of the impeller 6, and therefore, the foreign matter is easily removed from the gap between the suction port protrusion portion 50 and the vane portion 8. As a result, the passage performance of the foreign matter can be further improved.

In the present embodiment, as described above, the pump casing 3 has the foreign matter discharge groove 51 that has an elongated shape, is provided on the facing surface 5*b* on the counter-inflow direction side of the impeller 6, which faces the impeller 6, and extends from the inner periphery side toward the outer periphery side in the radial direction of the rotating shaft 1, and the end portion 51*a* on the inner periphery side in the radial direction of the foreign matter discharge groove 51 extends to the suction port protrusion portion 50. In this way, due to the foreign matter discharge groove 51, the constraint of the foreign matter in the gap between the first end face 81 and the second end face 82 of the vane portion 8 (the impeller 6) and the facing surface 5*b* of the pump casing 3, which faces the first end face 81 and the second end face 82 of the vane portion 8 can be suppressed. As a result, the passage performance of the foreign matter can be further improved.

In the present embodiment, as described above, the pump casing 3 includes the facing surface 5*b* that surrounds the suction port 30, faces the impeller 6 from the suction port side, and extends in the direction substantially orthogonal to the axial direction of the rotating shaft 1, the foreign matter discharge groove 51 is provided on the facing surface 5*b*, and the foreign matter discharge groove 51 is provided with the edge portion 51*c*, which changes an angle at which the foreign matter discharge groove 51 extends, in the vicinity of the boundary portion between the suction port protrusion portion 50 and the facing surface 5*b* when viewed from the axial direction of the rotating shaft 1. In this way, the foreign matter is caught in the edge portion 51*c*, and the vane portion 8 of the impeller 6 passes over the foreign matter caught in the edge portion 51*c*, so that the foreign matter can be cut.

In the present embodiment, as described above, the end portion 51*b* on the outer periphery side in the radial direction of the foreign matter discharge groove 51 is located on the outer periphery side with respect to the vane portion 8 in the radial direction. In this way, due to the foreign matter discharge groove 51, the foreign matter can be led to the outside of the gap between the first end face 81 of the vane portion 8 (the impeller 6) and the facing surface 5*b* of the pump casing 3, which faces the first end face 81 of the vane portion 8, and therefore, the passage performance of the foreign matter can be further improved.

In the present embodiment, as described above, the foreign matter discharge groove 51 is configured to become deeper toward the downstream side from the upstream side in the rotation direction of the impeller 6 along the rotation direction of the impeller 6. In this way, the foreign matter can be effectively pushed into the foreign matter discharge groove 51 along the rotation direction of the impeller 6, and therefore, the passage performance of the foreign matter can be further improved.

In the present embodiment, as described above, the foreign matter discharge groove 51 is configured to widen in width toward the outer periphery from the center of the pump casing 3. In this way, the foreign matter discharge groove 51 is gradually widened in the discharge direction, and therefore, the effect of pushing out the foreign matter in the discharge direction can be obtained.

In the present embodiment, as described above, in the rotation direction of the rotating shaft 1, the upstream-side side surface 50*a* of the suction port protrusion portion 50 is disposed in the angular range between the tongue portion 4*a* of the pump casing 3 and the angular position on the upstream side by 120 degrees with respect to the tongue portion 4*a*. In this way, the upstream-side side surface 50*a*, which is located at a position where the foreign matter is easily pushed into the pump chamber, can be disposed at a position relatively close to the tongue portion 4*a*. As a result, the sucked foreign matter can be immediately discharged with a time when it is present in the pump chamber 3*a* (volute) shortened. Therefore, it is possible to make it difficult for the foreign matter to be entangled in the tongue portion 4*a*, the impeller 6, or the like. As a result, the passage performance of the foreign matter can be further improved.

In the present embodiment, as described above, the impeller 6 is configured such that the flow path S1 on the negative pressure surface 83*a* side of the vane portion 8 is narrower than the flow path S2 on the pressure surface 83*b* side of the vane portion 8 on the main plate portion 7 side and the inner periphery side in the radial direction. In this way, by narrowing the flow path S1 on the negative pressure surface 83*a* side, the stay of the sucked foreign matter in the flow path S1 on the negative pressure surface 83*a* side is suppressed, and the foreign matter can be pushed into (be brought near) the flow path S2 on the pressure surface 83*b* side. That is, it is possible to easily discharge the foreign matter. As a result, the passage performance of the foreign matter can be further improved.

In the present embodiment, as described above, the main plate portion 7 is provided with the weight portion 71 having an annular shape and applying an inertial force to the impeller 6. In this way, due to a flywheel effect that is obtained by the weight portion 71, the inertial force of the rotating impeller 6 can be increased, and therefore, an increase in torque due to the crushing of the foreign matter and an impact can be canceled out. The flywheel effect is an effect of making the rotation speed of a rotating body rotating around a predetermined axis as uniform as possible (an effect of eliminating unevenness of the rotation speed of the rotating body).

In the present embodiment, as described above, the thickness on the outer periphery side in the radial direction of the vane portion 8 is larger than the thickness on the inner periphery side in the radial direction of the vane portion 8. In this way, due to the flywheel effect that is obtained by the vane portion 8, the inertial force of the rotating impeller 6 can be increased, and therefore, an increase in torque due to the crushing of the foreign matter and an impact can be canceled out. Further, it is possible to obtain the flywheel effect by the vane portion 8 that is an existing configuration.

In the present embodiment, as described above, the non-clogging pump further includes the electric motor 2 that rotates the rotating shaft 1, and the non-clogging pump is configured such that the rotational frequency of the electric motor 2 is changeable, and is configured such that in a case where the drive power value of the electric motor 2 falls below a predetermined first threshold value, the rotational frequency of the electric motor 2 is increased until the drive power value of the electric motor 2 reaches the predetermined first threshold value or the predetermined second threshold value exceeding the predetermined first threshold value. In this way, the span for crushing the foreign matter can be shortened by increasing the rotational frequency of the electric motor 2, and therefore, the foreign matter can be crushed finely. Further, by applying a larger centrifugal force to the passing foreign matter, it is possible to improve the act of pushing up the foreign matter on the inclined surface 73, and therefore, the foreign matter can be easily removed from the inclined surface 73 of the impeller 6. Further, a water suction speed (suction water amount) can be increased. As a result, the passage performance of the foreign matter can be further improved.

In the present embodiment, as described above, the non-clogging pump further includes the electric motor 2 that rotates the rotating shaft 1, and the non-clogging pump is configured such that in a case where a state where the drive power value of the electric motor 2 exceeds the drive power reference value is continued for a predetermined time or longer, the driving of the electric motor 2 is stopped, and the impeller 6 is rotated in a reverse direction when it is repeatedly determined that the state where the drive power value of the electric motor 2 exceeds the drive power reference value is continued for a predetermined time or longer, even if restart is attempted by a predetermined number of times. With this configuration, due to the reverse rotation of the impeller 6, the side surface of the main plate protrusion portion 70 and the inner periphery-side end portion 50*c* of the suction port protrusion portion 50 repeat approach and separation with respect to the foreign matter returned to the inner periphery side of the impeller 6, and therefore, the non-clogging pump 100 can effectively remove the foreign matter entangled in the impeller 6, the foreign matter constrained in the pump chamber 3*a*, or the like.

Modification Example

The embodiment disclosed here should be considered to be exemplary and not restrictive in all respects. The scope of the present invention is shown by the scope of claims rather than the description of the embodiment described above, and further includes all modifications (modification examples) within the meaning and scope equivalent to the scope of claims.

For example, in the embodiment described above, the example in which only the suction port protrusion portion is provided in the suction port is shown. However, the present invention is not limited to this. In the present invention, the suction port protrusion portion 50 and a recessed portion 201 may be provided in the suction port 30, as in a non-clogging pump 200 of the modification example shown in FIG. 15. Specifically, the inner peripheral wall that forms the suction port 30 of the pump casing 3 further includes, in addition to the suction port protrusion portion 50, the recessed portion 201 that is provided on the side opposite to the side where the suction port protrusion portion 50 is disposed, with respect to the rotating shaft 1 when viewed in a plan view, and recessed to the outer periphery side in the radial direction of the suction port 30. When viewed from the Z1 direction, the recessed portion 201 (the area of the portion recessed with respect to the arc of the suction port 30) is formed to be smaller than the suction port protrusion portion 50.

According to the configuration as described above, by providing the suction port protrusion portion 50 and the recessed portion 201, the center of the swirling flow that is generated in the vicinity of the suction port 30 can be made to be more eccentric, compared to a case where only the suction port protrusion portion 50 is provided. Therefore, it is possible to further suppress the entanglement of the foreign matter in the main plate protrusion portion 70 (refer to FIG. 1). As a result, the passage performance of the foreign matter can be further improved. Further, in a case where relatively large foreign matter flows in, the foreign matter can be cut and crushed by the recessed portion 201. Further, due to the recessed portion 201, even if large foreign matter flows in, the foreign matter is moved to the recessed portion 201, and the foreign matter can be crushed to a size that allows passage, by "cutting action and crushing action" due to a change in the relative position between the downstream-side side wall in the rotation direction of the recessed portion 201 (the rotation direction of the impeller 6) and the pressure surface-side edge of the leading edge (the second end face 82) of the rotating vane portion 8.

Further, in the embodiment described above, the example in which the non-clogging pump is a vertical type submersible electric pump is shown. However, the present invention is not limited to this. In the present invention, the non-clogging pump may be a horizontal type submersible electric pump. Further, a vertical type submersible electric pump in which a motor is disposed on the lower side and a pump casing is disposed on the upper side may be adopted.

Further, in the embodiment described above, the example in which the drive source of the non-clogging pump is configured with a motor is shown. However, the present invention is not limited to this. In the present invention, the drive source may be configured with an engine.

Further, in the embodiment described above, the example in which the non-clogging pump that is installed on the ground and operated is adopted is shown. However, the present invention is not limited to this. In the present invention, the pump may be configured as a submersible electric pump in which a float is mounted to the pump to float the pump in water, a motor faces downward, and a suction port faces upward.

Further, in the embodiment described above, the example in which only one foreign matter discharge groove is provided in the pump casing is shown. However, the present invention is not limited to this. In the present invention, a plurality of foreign matter discharge grooves may be provided in the pump casing.

Further, in the embodiment described above, the example is shown in which a configuration is made such that the depth of the foreign matter discharge groove gradually increases toward the downstream side from the upstream side in the rotation direction of the impeller. However, the present invention is not limited to this. In the present invention, a configuration may be made such that the depth of the foreign matter discharge groove gradually decreases toward the downstream side from the upstream side in the rotation direction of the impeller.

Further, in the embodiment described above, the example is shown in which a configuration is made such that the depth of the foreign matter discharge groove gradually increases toward the downstream side from the upstream side in the rotation direction of the impeller. However, the present invention is not limited to this. In the present invention, a configuration may be made such that the depth of the foreign matter discharge groove is changed from the inner periphery side toward the outer periphery side.

Further, in the embodiment described above, the example in which the impeller includes two vane portions is shown. However, the present invention is not limited to this. In the present invention, the impeller may include three or more vane portions.

Further, in the embodiment described above, the example is shown in which in the rotation direction of the rotating shaft, the upstream-side side surface of the suction port protrusion portion is disposed in an angular range between the tongue portion of the pump casing and the angular position on the upstream side by 120 degrees (in the K2 direction) with respect to the tongue portion. However, the present invention is not limited to this. In the present invention, for example, in the rotation direction of the rotating shaft, the upstream-side side surface of the suction port protrusion portion may be disposed at an angular position on the upstream side by an angle larger than 120 degrees (in the K2 direction) with respect to the tongue portion of the pump casing.

Further, in the embodiment described above, the example is shown in which the first end face is formed so as to extend in a substantially horizontal direction. However, the present invention is not limited to this. In the present invention, the first end face may be formed so as to be inclined with respect to the horizontal direction. For example, the first end face may be inclined with respect to the horizontal direction such that the inner periphery side in the radial direction is located in the counter-inflow direction (the downward direction). In this case, it is preferable that the first end face is inclined at an angle of degrees or smaller with respect to the horizontal direction. At this time, the first end face is inclined such that the angle formed by the first end face and the second end face is an obtuse angle.

Further, in the embodiment described above, the example is shown in which the suction port protrusion portion is formed in an angular range of 45 degrees or larger around the rotating shaft when viewed from the axial direction of the rotating shaft. However, the present invention is not limited to this. In the present invention, the suction port protrusion portion may be formed in an angular range of less than 45 degrees around the rotating shaft when viewed from the axial direction of the rotating shaft.

Further, in the embodiment described above, the example in which the pump casing is composed of two members, that is, the pump casing and the suction cover is shown. However, the present invention is not limited to this. In the present invention, the pump casing may be configured with only one member that is the pump casing main body. In this case, both the suction port and the discharge port are provided in the pump casing main body.

Further, in the embodiment described above, the example is shown in which the tip (the end portion on the lower side) of the main plate protrusion portion has a circular shape when viewed from below. However, the present invention is not limited to this. In the present invention, the tip (the end portion on the lower side) of the main plate protrusion portion may have a shape different from the circular shape, such as a rectangular shape or a gear shape, when viewed from below.

Further, in the embodiment described above, the example is shown in which the second end face (the first end face) of the vane portion is formed so as to be flat when viewed in a side view. However, the present invention is not limited to this. In the present invention, the second end face (the first end face) of the vane portion may be formed so as to be curved when viewed in a side view.

Further, in the embodiment described above, the example is shown in which the inner periphery-side end portion of the suction port protrusion portion is disposed on the inner periphery side in the radial direction of the rotating shaft with respect to the inner periphery-side end portion of the vane portion, which is connected to the main plate protrusion portion. However, the present invention is not limited to this. In the present invention, the inner periphery-side end portion of the suction port protrusion portion may be disposed at a position substantially corresponding to the inner periphery-side end portion of the vane portion in the radial direction.

Further, in the embodiment described above, the example is shown in which the inclination angle of the inclined surface with respect to the horizontal plane is smaller than 45 degrees. However, the present invention is not limited to this. In the present invention, the inclination angle of the inclined surface with respect to the horizontal plane may be 45 degrees or larger.

REFERENCE SIGNS LIST

1: rotating shaft
1*a*: one end
4*a*: tongue portion
5*b*: facing surface
6: impeller
7: main plate portion
8: vane portion
30: suction port
50: suction port protrusion portion
50*a*: upstream-side side surface
50*c*: inner periphery-side end portion (of the suction port protrusion portion)
51: foreign matter discharge groove
51*a*: end portion (on the inner periphery side of the foreign matter discharge groove)
51*b*: end portion (on the outer periphery side of the foreign matter discharge groove)
51*c*: edge portion
70: main plate protrusion portion
71: weight portion
73: inclined surface
73*a*: apex
73*b*: point (located on the bottom)
80: inner periphery-side end portion (of the vane portion)
81: first end face
82: second end face
83*a*: negative pressure surface
83*b*: pressure surface
100, 200: non-clogging pump
S1: flow path (on the negative pressure surface side of the vane portion)
S2: flow path (on the pressure surface side of the vane portion)

The invention claimed is:

1. A non-clogging pump comprising:

a pump casing provided with a suction port; and an impeller that includes a main plate portion and two or more vane portions that are disposed on a suction port side of the main plate portion, is fixed to one end of a rotating shaft, and is disposed inside the pump casing, wherein the main plate portion includes a main plate protrusion portion that protrudes from a central portion of the main plate portion in a counter-inflow direction that is a direction opposite to an inflow direction of water from the suction port, and the direction opposite to the inflow direction substantially coincides with an axial direction of the rotating shaft, each of the two or more vane portions includes a first end face facing in the counter-inflow direction, the first end face being located on an outer periphery side of the each of the two or more vane portions and extends in a direction intersecting the counter-inflow direction, and a second end face facing in the counter-inflow direction, the second end face being connected to the first end face, located between the first end face and the rotating shaft, inclined with respect to the first end face, and connected to the main plate protrusion portion at an end of the second end face that is opposite from the first end face, and an inner peripheral wall that forms the suction port of the pump casing includes a suction port protrusion portion that is provided in a rotation direction of the rotating shaft, is disposed along the second end face with a gap from the second end face, and protrudes toward a center side of the suction port, wherein the main plate protrusion portion and an inner periphery-side end portion of the suction port protrusion portion face each other without the two or more vane portions intervening between the main plate protrusion portion and the inner periphery-side end portion of the suction port protrusion portion.

2. The non-clogging pump according to claim 1, wherein an angle formed between the second end face and the first end face is an obtuse angle.

3. The non-clogging pump according to claim 1, wherein, when viewed from the axial direction of the rotating shaft, the suction port protrusion portion is formed around the rotating shaft at an inclination angle of 45 degrees with respect to a horizontal plane.

4. The non-clogging pump according to claim 1, wherein the inner periphery-side end portion of the suction port protrusion portion is disposed radially inside of an inner periphery-side end portion of the each of the two or more vane portions that is connected to the main plate protrusion portion, or disposed at a position substantially corresponding to the inner periphery-side end portion of the each of the two or more vane portions in the radial direction.

5. The non-clogging pump according to claim 1, wherein the main plate protrusion portion has, at a tip thereof, an inclined surface inclined with respect to a direction orthogonal to the counter-inflow direction.

6. The non-clogging pump according to claim 5, wherein the tip of the main plate protrusion portion has a substantially circular shape when viewed from the axial direction of the rotating shaft.

7. The non-clogging pump according to claim 5, wherein the inclined surface is provided on an entire tip of the main plate protrusion portion.

8. The non-clogging pump according to claim 5, wherein, on the counter-inflow direction side, an apex of the inclined surface is disposed at a substantially intermediate position between the two or more vane portions that are located in a vicinity of the apex in the rotation direction of the rotating shaft.

9. The non-clogging pump according to claim 5, wherein, in the counter-inflow direction, the inner periphery-side end portion of the suction port protrusion portion is disposed adjacent to a side surface of the main plate protrusion portion when viewed from the axial direction of the rotating shaft.

10. The non-clogging pump according to claim 5, wherein, in the counter-inflow direction, the inner periphery-side end portion of the suction port protrusion portion is disposed between an apex on the counter-inflow direction side of the inclined surface and a point that is located at an opposite end of the inclined surface from the apex.

11. The non-clogging pump according to claim 5, further comprising:

an electric motor that rotates the rotating shaft, wherein the non-clogging pump is configured such that in a state where a determination has been made a predetermined number of times that a drive power value of the electric motor exceeds a drive power reference value for a predetermined amount of time or longer, the impeller is rotated in a reverse direction even if restart is attempted with the electric motor stopped.

12. The non-clogging pump according to claim 1, wherein the each of the two or more vane portions is inclined from an inner periphery side thereof to the outer periphery side in the radial direction toward the counter-inflow direction.

13. The non-clogging pump according to claim 1, wherein the pump casing has a foreign matter discharge groove that has an elongated shape, is provided on a surface of the pump casing facing the impeller, and extends in the radial direction, and the foreign matter discharge groove extends to the suction port protrusion portion.

14. The non-clogging pump according to claim 13, wherein the surface of the pump casing facing the impeller surrounds the suction port, faces the impeller from the suction port side of the main plate portion, and extends in a direction substantially orthogonal to the axial direction of the rotating shaft, and the foreign matter discharge groove is provided with an edge portion, which changes an angle at which the foreign matter discharge groove extends, in a vicinity of a boundary portion between the suction port protrusion portion and the facing surface when viewed from the axial direction of the rotating shaft.

15. The non-clogging pump according to claim 13, wherein an end portion of the foreign matter discharge groove is located radially outside of the each of the two or more vane portions.

16. The non-clogging pump according to claim 13, wherein the foreign matter discharge groove is configured to become deeper from an upstream side of the impeller to a downstream side of the impeller along the rotation direction of the impeller.

17. The non-clogging pump according to claim 13, wherein the foreign matter discharge groove is configured to widen in width from a center of the pump casing toward an outer periphery of the pump casing.

18. The non-clogging pump according to claim 1, wherein, in the rotation direction of the rotating shaft, an angle between a position of an upstream-side side surface of the suction port protrusion portion and a tongue portion of the pump casing on an upstream side of the tongue portion is 120 degrees or less.

19. The non-clogging pump according to claim 1, wherein the impeller is configured such that a flow path on a negative pressure surface side of the each of the two or more vane portions is narrower than a flow path on a pressure surface side of the each of the two or more vane portions on a main plate portion side and the inner periphery side in the radial direction.

20. The non-clogging pump according to claim 1, wherein the main plate portion is provided with a weight portion having an annular shape and applying an inertial force to the impeller.

21. The non-clogging pump according to claim 1, wherein the each of the two or more vane portions has a greater thickness at a radially outer end thereof than at a radially inner end thereof.

22. The non-clogging pump according to claim 1, further comprising:

an electric motor that rotates the rotating shaft, wherein the non-clogging pump is configured such that a rotational frequency of the electric motor is changeable, and is configured such that in a case where a drive power value of the electric motor falls below a predetermined first threshold value, the rotational frequency of the electric motor is increased until the drive power value of the electric motor reaches the predetermined first threshold value or a predetermined second threshold value exceeding the predetermined first threshold value.

23. The non-clogging pump according to claim 1, wherein the inner peripheral wall that forms the suction port of the pump casing further includes, in addition to the suction port protrusion portion, a recessed portion that is provided on a side opposite to a side where the suction port protrusion portion is disposed with respect to the rotating shaft when viewed in a plan view, and is recessed to an outer periphery side in the radial direction of the suction port.

* * * * *